US007727594B2

(12) United States Patent
Shimoda et al.

(10) Patent No.: US 7,727,594 B2
(45) Date of Patent: Jun. 1, 2010

(54) METHOD FOR DRYING COATED FILM, AND APPARATUS THEREFOR

(75) Inventors: Kazuhiro Shimoda, Odawara (JP); Kyohei Yoshimura, Odawara (JP); Nobuo Hamamoto, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 122 days.

(21) Appl. No.: 12/015,246

(22) Filed: Jan. 16, 2008

(65) Prior Publication Data

US 2008/0172903 A1 Jul. 24, 2008

(30) Foreign Application Priority Data

Jan. 19, 2007 (JP) ..... 2007-010627
Feb. 23, 2007 (JP) ..... 2007-044671

(51) Int. Cl.
*B05D 3/04* (2006.01)

(52) U.S. Cl. ..... 427/378; 427/385.5

(58) Field of Classification Search ..... None
See application file for complete search history.

(56) References Cited

U.S. PATENT DOCUMENTS 3,645,778 A * 2/1972 Nesteruk ..... 427/477
5,853,801 A 12/1998 Suga et al.
2005/0087183 A1* 4/2005 Klobucar et al. ..... 126/21 A

FOREIGN PATENT DOCUMENTS

JP 2001170547 A 6/2001
SU 413216 * 6/1974

* cited by examiner

*Primary Examiner*—Erma Cameron
(74) *Attorney, Agent, or Firm*—Sughrue Mion, PLLC

(57) ABSTRACT

According to the drying method and apparatus of the present invention, at first, the coated film on one end side of the support is more quickly dried than that on the other end side, because drying air is supplied from one end side of the support. Subsequently, the coated film on the other end side of the support is more quickly dried than that on one end side, because drying air is supplied from the other end side of the support. Accordingly, the method and the apparatus can diminish a difference between drying rates in on one end side and in the other end side of the long support, in the whole drying zone. Thus, the method and the apparatus can uniformly dry the support and inhibit the production of a dry spot.

11 Claims, 12 Drawing Sheets

FIG.6

| | DIRECTION OF WIND IN DRYING APPARATUS | LENGTH (mm) OF WINDLESS ZONE | VELOCITY OF DRYING AIR (m/s) | | EVALUATION | | | |
|---|---|---|---|---|---|---|---|---|
| | | | FIRST DRYING ZONE IN DRYING ZONE | AVERAGE WIND VELOCITY (EXCEPT FIRST DRYING ZONE AND WINDLESS ZONE) | BROAD SPOT (A) | SHARP SPOT (B) | DRYING STATE OF OUTLET OF DRYING ZONE | GENERAL EVALUATION |
| COMPARATIVE EXAMPLE 1 | FIG. 5A | - | 0.5 | 0.2 | GOOD | BAD | INCOMPLETE DRYING IN EXHAUST SIDE | BAD |
| EXAMPLE 1 | FIG. 5E | - | 0.5 | 0.2 | FAIR | FAIR | EXCELLENT | FAIR |
| COMPARATIVE EXAMPLE 2 | FIG. 5B | 20 | 0.5 | 0.2 | BAD | BAD | INCOMPLETE DRYING IN EXHAUST SIDE | BAD |
| EXAMPLE 2 | FIG. 5C | 3000 | 0.5 | 0.2 | GOOD | FAIR | FAIR | FAIR |
| EXAMPLE 3 | FIG. 5C | 80 | 0.5 | 0.2 | GOOD | GOOD | EXCELLENT | GOOD |
| EXAMPLE 4 | FIG. 5C | 800 | 0.5 | 0.2 | EXCELLENT | GOOD | EXCELLENT | EXCELLENT |
| EXAMPLE 5 | FIG. 5C | 2000 | 0.5 | 0.2 | EXCELLENT | GOOD | GOOD | GOOD |
| EXAMPLE 6 | FIG. 5D | 80 | 0.5 | 0.2 | EXCELLENT | EXCELLENT | EXCELLENT | EXCELLENT |

FIG.7

COMPOSITION OF COATING LIQUID

| CONTENT OF COMPOSITION | | | COMPARATIVE EXAMPLE 3 | COMPARATIVE EXAMPLE 4 | EXAMPLE 7 | EXAMPLE 8 |
|---|---|---|---|---|---|---|
| | | | ADDED AMOUNT (kg) | ADDED AMOUNT (kg) | ADDED AMOUNT (kg) | ADDED AMOUNT (kg) |
| SOLVENT | MEK | | 102.00 | 102.00 | 102.00 | 102.00 |
| SOLID CONTENT | DISCOTIC LIQUID CRYSTALLINE COMPOUND | | 41.01 | 41.01 | 41.01 | 41.01 |
| | ETHYLENE-OXIDE-MODIFIED TRIMETHYLOLPROPANE ACRYLATE | BISCOAT #360 OSAKA ORGANIC CHEMICAL INDUSTRY CO., LTD. | 4.06 | 4.06 | 4.06 | 4.06 |
| | PHOTOINITIATOR | IRGACURE 907, MADE BY CIBA GEIGY JAPAN CO., LTD. | 1.35 | 1.35 | 1.35 | 1.35 |
| | SENSITIZER | KAYACURE DETX MADE BY NIPPON KAYAKU CO., LTD. | 0.45 | 0.45 | 0.45 | 0.45 |
| | CELLULOSE ACETATE BUTYRATE | CAB551-0.2 MADE BY EASTMAN CHEMICAL COMPANY | 0.34 | 0.34 | 0.34 | 0.34 |
| | CELLULOSE ACETATE BUTYRATE | CAB 531-1 MADE BY EASTMAN CHEMICAL COMPANY | 0.11 | 0.11 | 0.11 | 0.11 |
| | COPOLYMER CONTAINING FLUOROALIPHATIC GROUP CONTAINING ACIDIC GROUP | COMPOUND (P-0) | - | 0.05 | 0.25 | 0.15 |
| | COPOLYMER CONTAINING FLUOROALIPHATIC GROUP | COMPOUND (P-1) | - | 0.50 | - | - |
| | COPOLYMER CONTAINING FLUOROALIPHATIC GROUP | COMPOUND (P-2) | 0.35 | - | - | - |
| | COPOLYMER CONTAINING FLUOROALIPHATIC GROUP | COMPOUND (P-3) | - | - | 0.25 | - |
| | COPOLYMER CONTAINING FLUOROALIPHATIC GROUP | COMPOUND (P-4) | - | - | - | 0.25 |

FIG.8

| | | C6 MONOMER TERMINAL STRUCTURE | C6 MONOMER (mass%) | ALL F MONOMER (mass%) | PERIOD OF TIME AFTER APPLICATION (m sec) | | | RATIO OF SURFACE TENSIONS (10 m sec/ 1,000 m sec) | APPEARANCE CHARACTERISTIC |
|---|---|---|---|---|---|---|---|---|---|
| | | | | | 10 | 100 | 1000 | | |
| EXAMPLE 7 | P-3 | ωF | 50 | 40 | 25.0 | 22.5 | 21.9 | 1.1 | GOOD |
| EXAMPLE 8 | P-5 | ωF | 50 | 35 | 23.9 | 21.7 | 21.1 | 1.1 | GOOD |
| COMPARATIVE EXAMPLE 3 | P-2 | ωF | 100 | 40 | 28.2 | 22.5 | 20.8 | 1.4 | BAD |
| COMPARATIVE EXAMPLE 4 | P-1 | ωH | 100 | 90 | 25.6 | 23.0 | 22.6 | 1.1 | BAD |
| COMPARATIVE EXAMPLE 5 | P-6 | ωF | 0 | 38 | 28.4 | 23.7 | 22.0 | 1.3 | BAD |
| COMPARATIVE EXAMPLE 6 | P-7 | ωF | 0 | 36 | 28.1 | 25.8 | 21.9 | 1.3 | BAD |

* C6 MONOMER (mass): COMPOSITION RATIO IN POLYMER CONTAINING FLUORINE --- C6/(C4+C6)

* ALL F MONOMER (MASS): ALL FLUORINE COMPOSITION RATIO IN POLYMER CONTAINING FLUORINE --- (C4+C6)/(C4+C6+NON-FLUORINE POLYMER)

FIG.9

| | POLYMER CONTAINING FLUORINE | ABUNDANCE RATIO (%) OF FLUORINE ATOM | | | APPEARANCE CHARACTERISTIC |
|---|---|---|---|---|---|
| | | DISTANCE (nm) FROM INTERFACE BETWEEN COATED FILM AND AIR | | | |
| | | 0 | 5 | 10 | |
| EXAMPLE 7 | P-3 | 100 | 5 | 2 | GOOD |
| COMPARATIVE EXAMPLE 3 | P-2 | 100 | 0 | 0 | BAD |
| COMPARATIVE EXAMPLE 4 | P-1 | 78 | 42 | 23 | BAD |

METHOD FOR DRYING COATED FILM, AND APPARATUS THEREFOR

BACKGROUND OF THE INVENTION

1. Field of the Invention

The present invention relates to a method and an apparatus for drying a coated film, and in particular, relates to a method and an apparatus for drying the surface of a long and wide coated film formed on a long support by applying a coating liquid including an organic solvent thereon, when manufacturing an optical compensation sheet and the like.

2. Description of the Related Art

A liquid crystal display has an optical compensation sheet in order to improve its view angle characteristics, which is provided between a pair of polarizing plates and a liquid crystal cell as a phase difference sheet. A method of manufacturing a long optical compensation sheet includes the steps of: applying a coating liquid containing a resin for forming an orientational film on the surface of a long transparent film; and rubbing the coated film to form the orientational film. A manufacturing method further includes the steps of: applying a coating liquid containing a liquid crystalline discotic compound on the orientational film; and drying the coated film. The method of drying the coated film is disclosed in Japanese Patent Application Laid-Open No. 09-73081.

The method of drying the coating liquid containing the liquid crystalline discotic compound disclosed in Japanese Patent Application Laid-Open No. 09-73081 includes the steps of: applying the coating liquid containing the liquid crystalline discotic compound on the orientational film; and then initially drying the coating liquid in an air-conditioned atmosphere in a room to mainly vaporize an organic solvent contained in the coating liquid to dry the coating liquid, before drying the coating liquid in a regular drying apparatus.

However, the optical compensation sheet manufactured with the manufacturing method according to Japanese Patent Application Laid-Open No. 09-73081 produces two types of spots (irregularities) (A) and (B) as illustrated in FIG. 10 on the surface of the coated film 101 in an initial drying step. One is a broad spot (A) (shown by thin line), and the other one a sharp spot (B) (shown by thick line). The spots occasionally cause a problem of decreasing a yield of a product.

As a result of having analyzed these two spots (A) and (B), it was revealed that the broad spot (A) is caused by a reduced thickness of a coating liquid film 102 containing the liquid crystalline discotic compound, as is illustrated in FIG. 11. In FIG. 11, reference numeral 103 designates a long support, and reference numeral 104 designates an orientational film layer. On the other hand, it was revealed that an orientation portion 105 (deep color portion) having a sharp spot (B) formed therein showed an orientation direction 106 shifted from a regular orientation direction 107 in an orientation portion 108, as is illustrated in FIG. 12.

A general method employed as an effective measure against the spots (A) and (B) which are produced in the initial drying step includes a technique of increasing the viscosity of the coating liquid by increasing the concentration of the coating liquid or adding a thickening agent to the coating liquid; and thereby inhibiting a flow of the liquid on the surface of the coated film right after having been coated due to drying air to prevent the production of the spots. There is another method of preventing the production of the spots by using a solvent having a high boiling point. The solvent causes a leveling effect on the surface of the coated film right after having been coated, even when the liquid flowed on the surface due to the drying air.

However, a method of increasing the viscosity of the coating liquid by increasing the concentration of the coating liquid or adding the thickening agent has a problem of being incapable of performing a precise application for an ultra-thin layer in order to form a ultra-thin coated film with a high-speed application method. The method also has a disadvantage of extremely decreasing the production efficiency, because a threshold application speed (a threshold of a stable application speed) decreases along with the increase of the viscosity of the coating liquid, and the coating liquid having a higher viscosity cannot be applied at a higher speed.

On the other hand, a method of using a solvent having a high boiling point has a disadvantage of increasing a drying period of time, increasing an amount of a solvent remaining in the coated film to further increase the drying period of time, and consequently aggravating production efficiency.

With respect to such a background, the present applicant proposed a method and apparatus for drying a coated film as disclosed in Japanese Patent Application Laid-Open No. 2001-170547. The coating method and apparatus includes: providing a drying zone right directly behind an application section so as to surround the surface of a coated film to be dried on the above described running long support; and supplying a drying air so as to flow only in one direction from one end side to the other end side across the width of the above described long support in the above described drying zone. The coating method with the use of the coating apparatus can uniformly dry the coated film without changing physical properties such as a viscosity of a coating liquid or a type of a solvent. The above Japanese Patent describes that the drying method and apparatus can inhibit the production of the above described spots.

SUMMARY OF THE INVENTION

However, the method according to Japanese Patent Application Laid-Open No. 2001-170547 dries a coating liquid in one end in a cross direction of a long support more slowly than that in the other end side, because of supplying a drying air as to flow only in one direction from one end side to the other end side across the width of the long support. Accordingly, the method needs to more quickly dry the coating liquid in a supply side of the drying air in order to complete drying the coating liquid in a drying apparatus, and consequently may have caused a spot in an initial drying process.

The present invention has been achieved in view of such problems and an object thereof is to provide a drying method and apparatus which can remarkably inhibit a spot produced in the initial drying process right after an application step, and can uniformly dry a coated film without changing physical properties such as a viscosity of a coating liquid or a type of a solvent.

In order to achieve the above described object, a first aspect according to the present invention provides a method for drying a coated film formed by applying a coating liquid containing an organic solvent onto a running long support, the method which sequentially conducts, immediately after the application, following steps in a drying zone where a coated surface to be dried of the running support is surrounded: a forward wind drying step of drying the surface of the coated film with a forward wind while running the long support in a forward wind zone in which such a drying air is supplied as to flow only in one direction from one end side to the other end side across the width of the long support; and a reverse wind drying step of drying the surface of the coated film with a reverse wind while running the long support in a reverse wind zone in which such a drying air is supplied as to flow only in one direction reverse to that in the forward wind zone, i.e., from the other end side to one end side across the width of the long support.

The drying method according to a first aspect includes providing a drying zone right directly behind an application section, drying the coated film with the forward wind in the drying zone in which such a drying air is supplied as to flow only in one direction from one end side to the other end side across the width of the running long support toward the surface of the coated film formed on the support, and then drying the coated film with the reverse wind flowing in the reverse direction to that in the forward wind zone, i.e., flowing from the other end side to one end across the width of the running long support. Thereby, at first, the coated film on one end side of the support is more quickly dried than that on the other end side, because drying air is supplied from one end side of the support.

Subsequently, the coated film on the other end side of the support is more quickly dried than that on one end side, because drying air is supplied from the other end side of the support. Accordingly, the method can diminish a difference between drying rates in on one end side and in the other end side of the long support, in the whole drying zone. Thus, the method can uniformly dry the support and inhibit the production of a dry spot.

A second aspect is the drying method according to the first aspect, wherein the forward wind drying step and the reverse wind drying step are alternately repeated several times.

The method according to the second aspect can uniformly dry one end side and the other end side of the support, because of repeating the forward wind drying step and the reverse wind drying step several times, and can precisely control a drying rate.

A third aspect is the drying method according to any one of the first and second aspects, further including carrying out a windless drying step of drying the surface of the coated film while running the long support in a windless zone in which the drying air is not blown, in between the forward wind drying step and the reverse wind drying step.

The drying method according to the third aspect comprises the windless drying step in between the forward wind drying step and the reverse wind drying step. Accordingly, the method can supply drying air flowing only in one direction, because drying air flowing from one end side to the other end side of the support is not mixed with drying air flowing from the other end side to the one end side in an opposite direction to the above drying air.

In addition, because the windless zone is provided, drying air exhausted from the other end side of a forward wind zone is hardly supplied into a drying zone as drying air to be supplied from the other end side in a reverse wind zone, and accordingly, drying air containing no organic solvent can be supplied into the reverse wind zone and a drying rate can be increased.

A fourth aspect is the drying method according to the third aspect, wherein the windless zone has a length of 80 mm or longer but 2,000 mm or shorter in a running direction of the long support.

The drying method according to the fourth aspect sets a dimension of the windless zone in the above described range, and accordingly does not supply drying air which has finished drying and has been exhausted from a forward wind zone or a reverse wind zone adjacent to each other into a drying zone again as drying air. Then, the drying air supplied into the drying zone does not contain an organic solvent, and can increase the drying rate. In addition, the drying air in the forward wind zone and the drying air in the reverse wind zone flowing reverse to the drying air of the forward wind zone are not mixed in the drying zone, so that drying air flowing only in one direction can be supplied.

A fifth aspect is the drying method according to any one of the first to fourth aspects, wherein the coated film to be dried is formed by applying a coating liquid for a liquid crystal layer on an oriented film undergone a rubbing treatment in a process for manufacturing an optical compensation sheet.

This is because the drying method according to the present invention is particularly effective when drying the coated film formed by applying the coating liquid for the liquid crystal layer onto the oriented film coated on a long support and undergone the rubbing process.

A sixth aspect is the drying method according to any one of the first to fifth aspects, wherein the coating liquid includes a polymer containing a fluoroaliphatic group containing a repetition unit derived from monomers described in the following item (1), and wherein the polymer containing the fluoroaliphatic group satisfies the condition described in the following item (2):

(1) a polymer containing a fluoroaliphatic group includes a monomer containing a first fluoroaliphatic group having a terminal structure expressed by $—(CF_2CF_2)_3F$, and a monomer containing a second fluoroaliphatic group having a terminal structure expressed by $—(CF_2CF_2)_2F$; and (2) the coating liquid shows a ratio of surface tension at 10 m-sec to surface tension at 1,000 msec (surface tension at 10 msec after the coating liquid has been applied/surface tension at 1,000 msec after the coating liquid has been applied) of 1.00 to 1.20 when the surface tension is measured with a maximum bubble pressure method on a coating liquid having a product C×F of 0.05 to 0.12, where (C) is the concentration by mass % of the polymer containing the fluoroaliphatic group in the coating liquid, and (F) is a fluorine content by % in the polymer containing the fluoroaliphatic group.

The drying method according to the sixth aspect adds a polymer containing a fluoroaliphatic group, which includes a repeating unit of the monomer described in the above item (1) and satisfies the above described (2), into the coating liquid. Thereby, the polymer containing the fluoroaliphatic group promptly moves to the interface between the air and the coating liquid in an initial drying step after the coating liquid has been applied, and consequently stabilizes the interface between the air and the coating film, so that the drying method can inhibit the production of a dry irregularity even when drying a coated film at a high speed under a condition of easily producing the dry irregularity caused by increasing the amount of a coating liquid to be applied. When the product C×F is less than 0.05, a liquid crystal compound is not sufficiently controlled in the interface between the air and the coated film and causes a problem that an optical film shows unsatisfactory appearance characteristics (unsatisfactory degree of irregularity). When the product C×F is more than 0.12, application properties of a liquid crystalline composition when applied onto a transparent support are not sufficient, which causes a problem that an optical film shows unsatisfactory appearance characteristics (due to repellency defect). When the product C×F is in the above described range, the coating liquid does not cause such problems and can further reduce irregularities in the initial drying step.

A ratio of the surface tension described in the item (2) is a value mainly measured at room temperature (25° C.). The surface tension of the coating liquid can be measured with a maximum bubble pressure method by using a dynamic surface tension measuring apparatus (MPT2, made by LAUDA). The amount of the coating liquid to be applied is preferably 5.0 to 6.4 $mL/m^2$.

A seventh aspect is the drying method according to any one of the first to sixth aspects, wherein the formed coating film shows an abundance ratio of a fluorine atom (F/C) measured with an ESCA method of 2 to 10, at a position of 10 nm from the interface between the air and the coating film in a depth direction, when the abundance ratio of the fluorine atom (F/C) measured at the interface between the air and the coating film is assumed to be 100.

The drying method according to the seventh aspect makes the fluorine concentration of the coating film high on the surface, makes fluorine exist in the inner part of the coating film as well, and accordingly can form the coating film showing an excellent appearance characteristics.

In order to achieve the above described object, an eighth aspect according to the present invention provides an apparatus for drying a coated film formed by applying a coating liquid containing an organic solvent onto a running long support with an applicator, comprising: a main body of the drying apparatus which is provided right directly behind the applicator and forms a drying zone so as to surround the surface of the coated film to be dried on the running long support, and partitioning plates for dividing the inside of the main body of the drying apparatus into a plurality of zones in a direction of running the long support, wherein the plurality of the divided zones are constituted by: a forward wind zone provided with a one-directional airflow generation device which generates drying air flowing only in one direction from one end side to the other end side across the width of the long support; and a reverse wind zone provided with a one-directional airflow generation device which generates drying air flowing only in one direction reverse to that in the forward wind zone, i.e., from the other end side to one end side across the width of the long support.

The main body of the drying apparatus according to the eighth aspect comprises the forward wind zone provided with the one-directional airflow generation device which generates drying air flowing only in one direction from one end side to the other end side across the width of the long support, and the reverse wind zone provided with the one-directional airflow generation device which generates drying air flowing in a reverse direction to the forward wind zone. Accordingly, even when a coated film in the other end side of the long support is more slowly dried than that in one end side in the forward wind zone, drying air supplied from the other end side in the reverse wind zone adjusts a drying rate and can uniformly dry the long support. In addition, the forward wind zone and the reverse wind zone are divided by a partitioning plate, so that opposing drying airs are not mixed and the supplied drying air can flow only in one direction.

A ninth aspect is the drying apparatus according to the eighth aspect, wherein a plurality of the forward wind zones and the reverse wind zones are alternately arranged.

The drying apparatus according to the ninth aspect comprises a plurality of the forward wind zones and the reverse wind zones alternately arranged, and accordingly can diminish a difference between drying rates of coated films in one end side and in the other end side of the support. Thus, the drying apparatus can uniformize drying rates for the coated films on the support, and inhibit the production of a dry spot.

A tenth aspect is the drying apparatus according to any of the eighth and ninth aspects, further including a windless zone in which drying air is not blown arranged in between the forward wind zone and the reverse wind zone.

The drying apparatus according to the tenth aspect comprises the windless zone arranged in between the forward wind zone and the reverse wind zone, so that drying airs in the forward wind zone and in the reverse wind zone are not mixed, and supplied drying air can flow only in one direction. In addition, the drying apparatus does not supply drying air exhausted from the forward wind zone or the reverse wind zone into its adjacent reverse wind zone or forward wind zone respectively, and accordingly can supply drying air containing no organic solvent.

EFFECTS OF THE INVENTION

A drying method and apparatus according to the present invention supplies drying airs in opposite directions in a drying zone, thereby can uniformly dry the coated film on a long support, and can inhibit the production of a dry spot.

BRIEF DESCRIPTION OF THE DRAWINGS

FIG. 6 is a table view showing results of the present example;

FIG. 7 is a table view showing results of the present example;

FIG. 8 is a table view showing results of the present example;

FIG. 9 is a table view showing results of the present example;

DETAILED DESCRIPTION OF THE PREFERRED EMBODIMENTS

Preferred embodiments of a method and apparatus for drying a coating film according to the present invention will now be described in detail with reference to the attached drawings.

Figure 1:
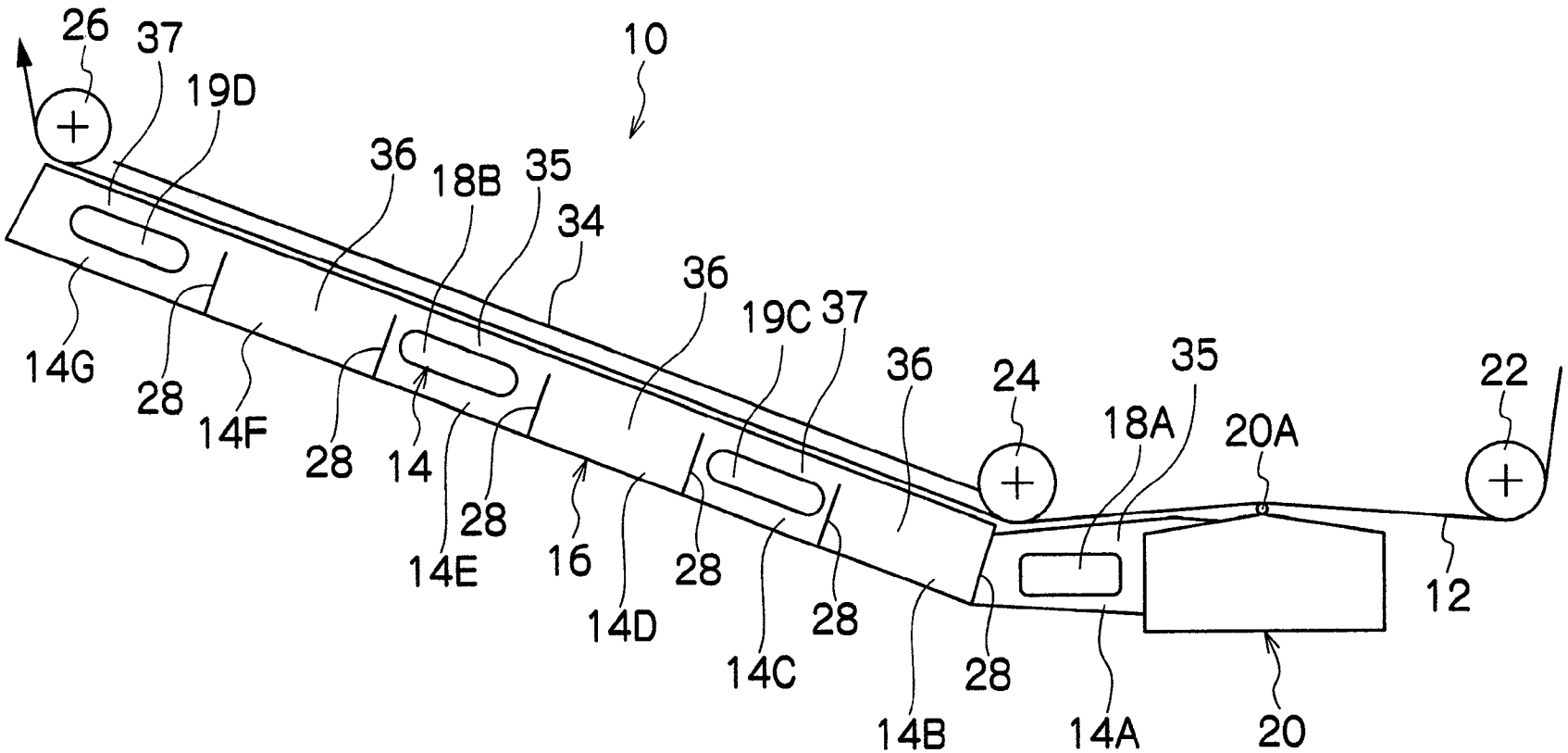
FIG. 1 is a side view of a drying apparatus according to the present invention.
Figure 2:
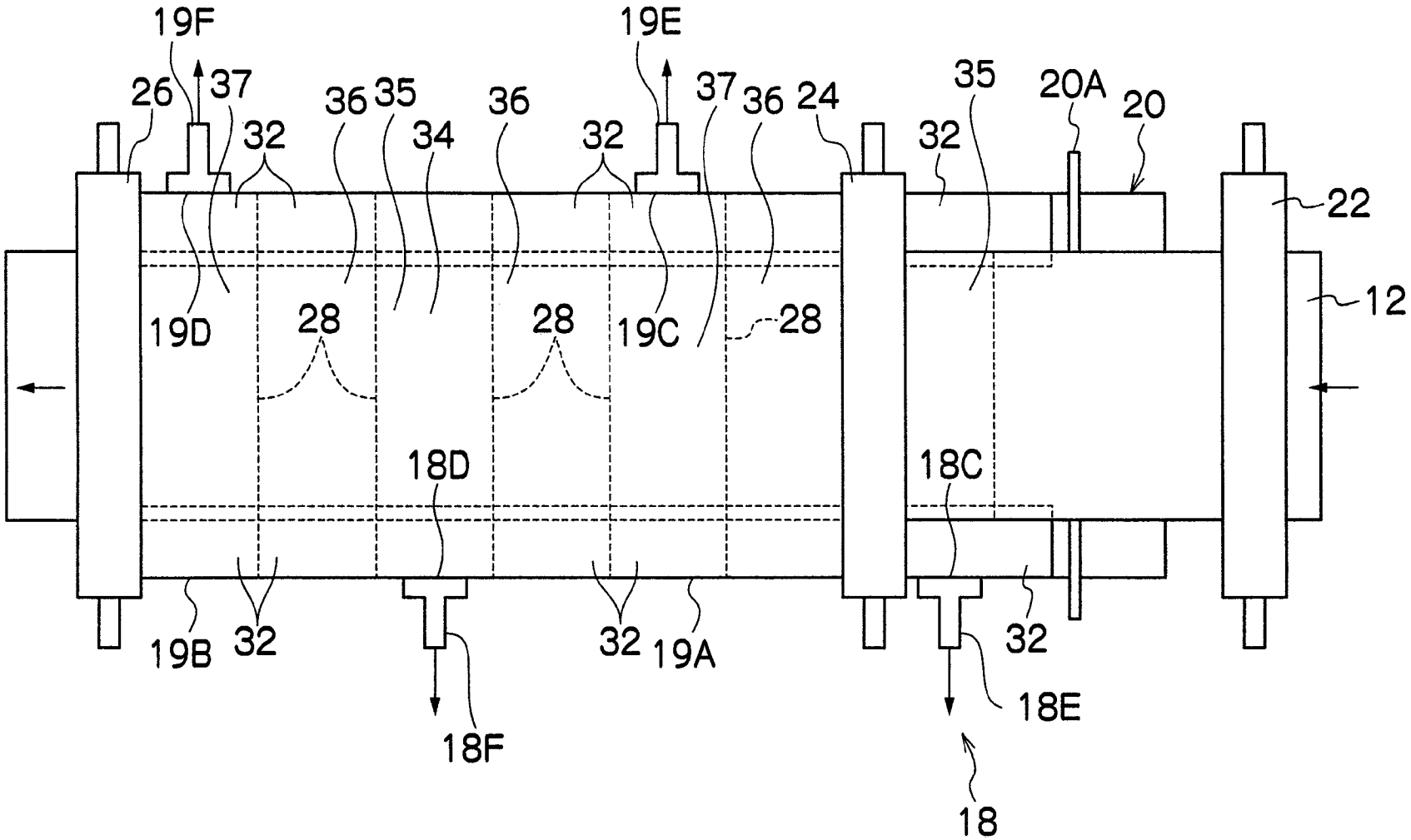
FIG. 2 is a plan view of a drying apparatus according to the present invention.

FIG. 1 is a side view of an apparatus for drying a coated film according to the present invention. FIG. 2 is a plan view of FIG. 1 when viewed from the upper part.

As illustrated in FIG. 1 and FIG. 2, an apparatus 10 for drying a coated film according to the present invention mainly comprises: a main body 16 of the drying apparatus which forms a drying zone 14 for drying the coated film while passing a running long support 12 (hereinafter referred to as a web 12) therein; a forward wind zone 35 provided with a one-directional airflow generation device 18 which generates drying air flowing only in one direction from one end side to the other end side across the width of the web 12; a windless zone 36 in which drying air is not supplied; and a reverse wind zone 37 provided with a one-directional airflow generation device 19 which generates drying air flowing only in one direction from the other end side to one end side across the width of the web 12. The inside of the drying zone 14 is divided into the forward wind zone 35, the windless zone 36, and the reverse wind zone 37 by a partitioning plate 28. The drying apparatus 10 is placed right at the rear of an applicator 20 which applies a coating liquid containing an organic solvent on the running web 12. The above drying apparatus 10 is not limited to such a drying apparatus as illustrated in FIGS. 1 and 2, but a condensation type drying apparatus as is described in Japanese Patent Laid-Open No. 2003-93952 can be used.

In the present invention, a windless zone means a zone in which drying air is not supplied. Because a line moves when a coating liquid is applied, a wind is generated along with a web in a traveling direction of the web, but the drying zone is referred to as the windless zone as long as drying air is not supplied therein, in the present invention. When a wind velocity in the windless zone is measured with a wind speed indicator when the line stops, the wind velocity of 0.1 m/s or less may be detected, but the drying zone is referred to as the windless zone in the present invention, even though the wind velocity were detected.

An applicator 20 can employ, for instance, a bar coating device provided with a wire bar 20A, applies a coating liquid to the bottom surface of a web 12 which is supported by a plurality of support rollers 22, 24 and 26 to run, and thereby forms a coated film.

A main body of a drying apparatus 16 is placed right at the rear of an applicator 20, and is formed into a rectangular box shape along a coating film surface side (bottom surface side of a web) of the running web 12. Among each side of the box, the coating film surface side (upper side of the box) is removed. Thereby, a drying zone 14 is formed which surrounds the surface of the coated film to be dried on the running web 12. The drying zone 14 is constituted by a plurality of divided zones 14A, 14B, 14C, 14D, 14E, 14F and 14G (seven divided zones in the present example) which are formed by partitioning the main body 16 of the drying apparatus with a plurality of partitioning plates 28, 28 . . . that are installed perpendicular to the running direction of the web 12. In addition, in the present example, forward wind zones and reverse wind zones are alternately arranged, and windless zones are placed between the forward wind zone and the reverse wind zone. Specifically, divided zones 14A and 14E constitute the forward wind zone 35, divided zones 14B, 14D, and 14F constitute the windless zone 36, divided zones 14C and 14G constitute the reverse wind zone 37. In the arrangement, a space between a top end of the partitioning plate 28 for dividing the drying zone 14 and the coated film surface formed on the web 12 is preferably in a range of 0.5 mm to 12 mm, and is further preferably in a range of 1 mm to 10 mm. The forward wind zone 35 is provided with a one-directional airflow generation device 18 which generates drying air flowing only in one direction from one end side to the other end side of the web 12. On the other hand, the reverse wind zone 37 is provided with a one-directional airflow generation device 19 which generates drying air flowing only in one direction from the other end side to one end side of the web 12. In the windless zone, the coated film can be dried with a drying method according to the present invention even though a wind is not supplied, but the windless zone can be provided with the one-directional airflow generation device. In the present example, the forward wind zone 35, the windless zone 36, and the reverse wind zone 37 were arranged into a configuration as shown in FIG. 1, but can be appropriately modified according to a type of a coating liquid and the easiness of being dried of the coating liquid. In the present example, the drying zone is constituted by divided zones each having a different wind direction from each other, but two or more zones having the same wind direction can be continuously arranged in a row.

A one-directional airflow generation device 18 is formed in one end side of both sides in a main body 16 of the drying apparatus, and is constituted by suction openings 18A and 18B, outlets 18C and 18D formed so as to face the suction openings 18A and 18B in the other end side, and exhaust devices 18E and 18F connected to the outlets 18C and 18D. Then, when the exhaust devices 18E and 18F are driven, the devices exhaust air which has been sucked into the divided zone through the suction opening, from the outlets 18C and 18D, and accordingly generate drying air flowing only in one direction from one end side (suction opening side) to the other end side (outlet side) across the width of a web 12 in each of the divided zones 14A and 14E. Here, the divided zones 14A to 14G are divided by respective partitioning plates 28, so that drying air in one divided zone is not supplied to another divided zone. Accordingly, air which has been supplied in one divided zone is exhausted in the same divided zone, and drying air is supplied only in one direction. The one-directional airflow generation device 18 has such a structure as to be able to separately control an amount of exhausted air in each of the divided zones 14A and 14E by the exhaust devices 18C and 18D. The drying air to be sucked from the suction openings 18A and 18B is preferably a conditioned air of which the temperature and humidity are conditioned. A one-directional airflow generation device 19 installed in a reverse wind zone has a similar structure except that suction openings 19A and 19B, outlets 19C and 19D, and exhaust devices 19E and 19F are positioned in a reverse direction to that in the forward wind zone with respect to the width direction of the web 12, and can supply drying air into the drying zone through the structure.

The lengths of the forward wind zone 35 and the reverse wind zone 37 are preferably 80 mm or longer but 1,200 mm or shorter, and further preferably are 80 mm or longer but 800 mm or shorter in a running direction of the long support. One end side and the other end side in a width direction of the long support can be uniformly dried by setting the lengths of the forward wind zone and the reverse wind zone into the above described range. In addition, a length of a drying zone nearest to an applicator is preferably 80 mm or longer but 1,600 mm or shorter. The production of a broad spot (A) can be inhibited by setting the length of the drying zone (14A in the exemplary example) nearest to the applicator at the above described range, because the coated film is sufficiently dried in an early stage of drying. When the length of the drying zone is shorter than 80 mm, the coated film is not sufficiently dried and a drying rate is decreased. On the other hand, when the length of the drying zone is longer than 1,600 mm, the initial drying is finished, the drying rate is easily affected by the wind, and consequently the broad spot (A) tends to be easily produced.

In addition, the length of an windless zone 36 is preferably 80 mm or longer but 2,000 mm or shorter, and further preferably is 80 mm or longer but 1,200 mm or shorter. When the length of the windless zone 36 is set at the above described range, supplied drying air can flow only in one direction without mixing of drying airs in the forward wind zone and the reverse wind zone. Extension in the length of the windless zone is unpreferable because the coated film is dried slowly.

In the above description, the lengths of the forward wind zone 35, the windless zone 36 and the reverse wind zone 37 respectively mean the sum of lengths of adjacent divided zones when the zone is formed of the plurality of adjacent divided zones.

An average wind velocity of drying air in a drying zone nearest to an applicator is preferably 0.3 m/s or more but 0.6 m/s or less. The production of a broad spot (A) can be inhibited by setting the average wind velocity at the above described range, because the coated film is sufficiently dried in an early stage of drying. When the wind velocity is 0.3 m/s or less, the coated film is not sufficiently dried and a drying rate is decreased. On the other hand, when the wind velocity is 0.6 m/s or more, the drying rate is increased, a changing point of the dried state is positioned in the nearest drying zone to the applicator, and consequently the broad spot (A) tends to be easily produced.

The average wind velocity of the drying air in the drying zones except a windless zone 36 and the nearest drying zone to the applicator is preferably 0.1 m/s or more but 0.3 m/s or less. In a termination stage of drying, a sharp spot (B) is produced by a wind in a direction different from a rubbing direction of a rubbing treatment which is applied onto an orientational film under the coated film. The production of the sharp spot (B) can be inhibited by supplying drying air weaker than the drying air in the early drying stage to a fixed direction. Accordingly, it is preferable to supply the drying air with the air velocity in the above described range.

The average wind velocity in the present invention can be determined by determining respective values by multiplying an absolute value of a wind velocity in each divided zone with a length of a web in each divided zone in a transportation direction, adding the respective values, and dividing the sum by the overall length of the zones of which the average wind velocity is to be determined.

A width of a main body 16 of a drying apparatus is formed so as to be larger than that of a web 12. In both sides of a drying zone 14, straightening plates 32 for covering the opened parts in the both sides are installed to form straightening sections. The straightening sections secure distances between each of suction openings 18A, 18B, 19A and 19B and the end of a coated film and distances between the end of the coating film and each of outlets 18C, 18D, 19C and 19D, simultaneously facilitate drying air to be sucked only from the suction openings 18A, 18B, 19A, 19B into the drying zone 14, and prevent the drying air from forming a rapid flow in the drying zone 14. The length of the straightening section, specifically, the length of the straightening plate 32 is preferably in a range of 50 mm or longer but 150 mm or shorter, in both of a suction opening side and an outlet side.

It is important particularly in the nearest divided zone 14A to the applicator among the divided zones 14A to 14G to inhibit fresh air outside the drying zone 14, for instance, the above described air-conditioned wind from entering into the drying zone 14 right after a coating liquid has been applied onto the web 12. For the purpose, it is preferable to place the divided zone 14A so as to be adjacent to the applicator 20, and configure the divided zone 14A as if the web 12 covers the opened part of the divided zone 14A by adjusting the positions of a wire bar 20A of the applicator 20 and a support roller 24, in addition to the above described straightening plate 32 so that the web 12 can run in the vicinity of the divided zone 14A.

In addition, a shielding plate 34 is installed at a position in the opposite side of the main body 16 of the drying apparatus across the web 12 so that a wind like the above described air-conditioned wind does not hinder the web 12 from stably running.

In the next place, the function of the drying apparatus 10 configured as described above will be described.

In the following description, the web 12 shall have a layer to be an orientational film through a rubbing treatment of rubbing a previously applied resin for forming the orientational film, and a coating liquid shall be an organic solvent type coating liquid containing a liquid crystalline discotic compound, for instance.

The drying apparatus 10 initially dries the surface of a coated film right after an applicator 20 has applied a coating liquid onto a web 12 which runs while being supported by support rollers 22, 24 and 26, with a wire bar 20A. It is preferable to start the initial drying with drying air within at least 5 seconds right after the coating liquid has been applied.

In an early stage of drying, the surface of the coated film right after having been applied is in a state of sufficiently containing an organic solvent, and in the early stage of drying right after the coating liquid particularly containing the organic solvent as a solvent has been applied, a temperature distribution occurs on the surface of the coated film due to the distribution (weave) of the evaporation of the organic solvent. This causes the distribution of a surface tension, the coating liquid flows in the surface of the coated film, a slowly dried part of the coated film is thinned, and thus a broad spot (A) is produced.

The broad spot does not appear when the coated film is quickly dried, so that it is effective to increase a blown speed of drying air in an early stage. However, the present inventors found that when the drying air is not blown at all in a drying zone in which the broad spot can be produced, the broad spot is not conversely produced at all. This is the reason why a windless zone is provided.

In other words, the production of the broad spot can be inhibited by increasing the blown speed of drying air in the early stage, or by blowing no drying air. However, when the coated film reaches a changing point of a dried state, a distribution of a drying rate increases, then the drying rate remarkably changes due to the influence of the drying air, and the broad spot (A) is produced. On the other hand, when the coated film is dried without supplying drying air at all from the beginning, a long period is required for drying the coated film, and a problem of degrading the production efficiency is not solved.

In order to solve such a problem, a possible method for inhibiting the production of the broad spot (A) is to make the drying zone corresponding to the changing point of the dried state windless and extremely decrease the drying rate. For this reason, the production of the spot can be inhibited by positioning the changing point of the dried state in the windless zone, which is preferable.

On the other hand, an orientation direction of a liquid crystalline discotic compound is determined by rubbing the surface of a resin for forming an orientational film. When drying air hits the surface of the coated film, which is produced when a rapid wind blows in a different direction from a rubbing direction in an early stage of drying, winds in different directions join or a vortex of wind occurs, the drying air shifts the orientation direction in one part of the surface of the coated film and causes a sharp spot (B). Accordingly, it is important to blow a weak wind in such a range as not to produce the sharp spot after the coated film has passed through the drying zone in which a broad spot might be produced. This is an effect of drying the coated film by blowing drying air again onto the film when the whole film has passed a constant rate drying period and has reached a lapse rate drying period. In addition, when winds in different directions join, the winds cause the sharp spot (B), so that it is preferable to provide the windless zone in between a forward wind zone and a reverse wind zone in order to prevent the mixing of the winds.

For this reason, in order to prevent the spots (A) and (B) from forming on the surface of the coated film in the early stage of drying, it is important to prevent a nonuniform wind from coming from the outside and hitting the surface of the coated film in the early stage of drying, after a coating liquid has been applied and before the coated liquid stops flowing on the surface of the coated film, and simultaneously to keep an organic solvent concentration in the vicinity of the surface of the coated film at a constant level.

Figure 4:
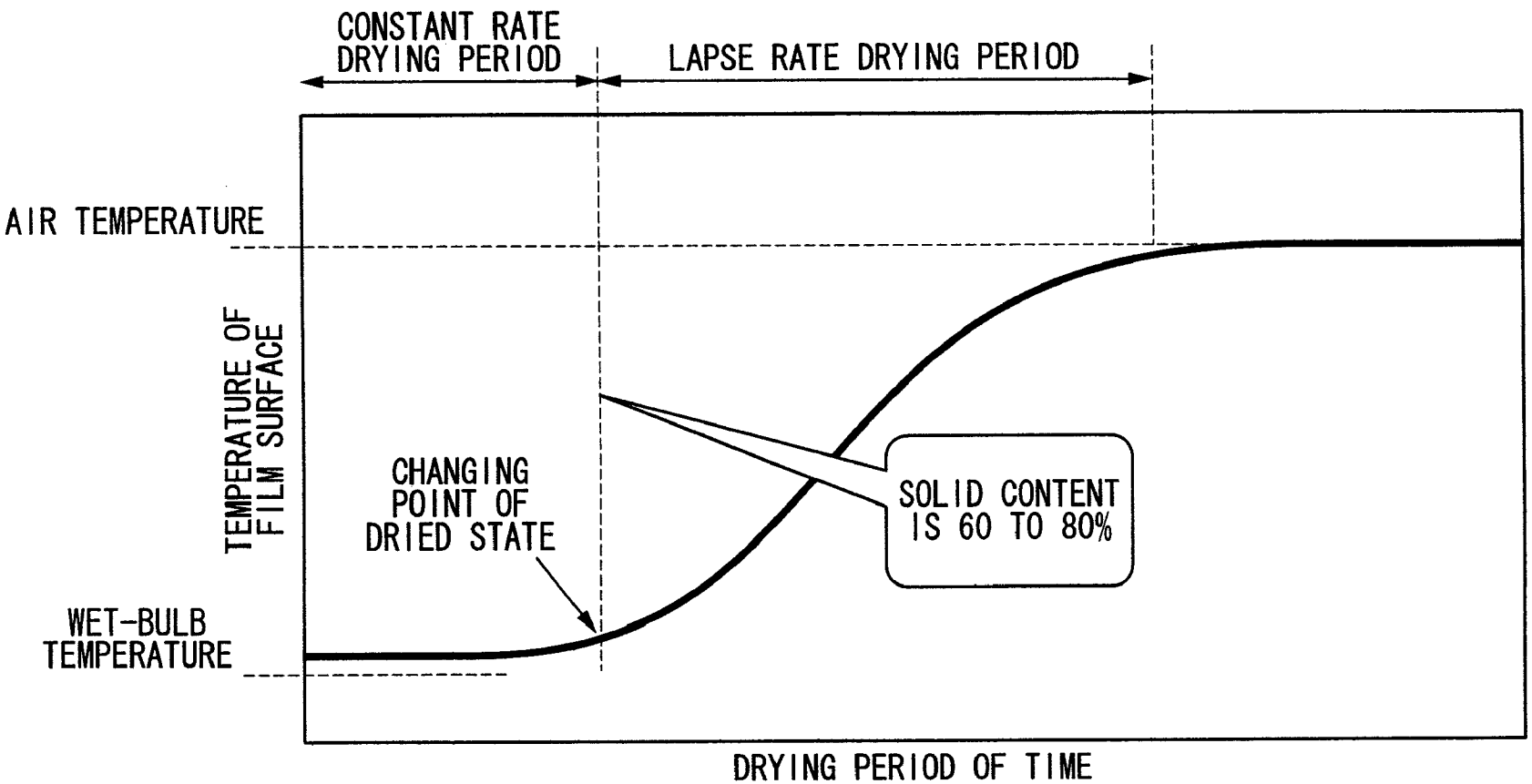
FIG. 4 is a view showing a change of a temperature of a wet bulb with respect to a drying period of time.

Here, a drying period will be described. It is described in detail in Section of Drying, in "Handbook of Chemical Engineering (Maruzen Co., Ltd.)". FIG. 4 illustrates a change of a temperature on the surface of a coated film with respect to a drying period of time. In FIG. 4, a horizontal axis presents the drying period of time and a vertical axis presents the temperature of the surface of the coated film. When the coated film is dried at constant air velocity and at air temperature, the temperature of the surface of the coated film is kept at a wet bulb temperature and rises after a certain period of time, as is illustrated in FIG. 4. A period before temperature rises is referred to as a constant rate drying period. In the period, the temperature of the coated film is kept at the wet bulb temperature, a volatile component can sufficiently quickly migrate in the film, and a sufficient amount of a volatile liquid exists in the film to evaporate from the surface.

However, in the lapse rate drying period when the temperature of the coated film starts rising, the volatile component in the film is insufficient on the surface, and a drying rate decreases even when the same drying air is applied. This critical point is referred to as a changing point of a dried state, at which a solid content reaches 60 to 80%.

The solid content described above is determined by the following expression:

solid content amount (%)=solid content/(volatile component+solid content)×100.

The solid content and (volatile component+solid content) can be determined by the following expressions (1) and (2) through measuring the weights:

solid content=[*A:* weight of film having been finished drying]−[*B:* weight of support before being coated]; and (1)

volatile component+solid content=[*C:* weight of film sampled in a certain drying zone]−[*B:* weight of support before being coated] (2).

Accordingly, an amount of the solid content can be obtained by measuring the following weights, when a sample is collected in a certain zone:

A: weight of sample after having been bone-dried at boiling point of volatile component or higher;

B: weight measured after film of above (A) has been removed; and

C: weight measured immediately after having been sampled.

A web 12 to be used in the present invention has a width of 0.3 to 5 m, a length of 45 to 10,000 m and a thickness of 5 to 200 μm, in general, and includes a film made from a plastic material such as polyethylene terephthalate, polyethylene-2, 6-naphthalate, cellulose diacetate, cellulose triacetate, cellulose acetate propionate, polyvinyl chloride, polyvinylidene chloride, polycarbonate, polyimide, polyamide; paper; paper coated or laminated with α-polyolefin having 2 to 10 carbon atoms, such as polyethylene, polypropylene and an ethylene butene copolymer; a foil of a metal such as aluminum, copper and tin; and a belt-shaped substrate having a preliminarily worked layer formed on the surface. The above described web 12 further includes a sheet formed by the steps of: applying a coating liquid for an optical compensation sheet, a magnetic coating liquid, a photography photosensitive coating liquid, a coating liquid for surface protection and static elimination or lubrication on the surface of the film or the substrate; drying the liquid, and then cutting the film or the substrate into a desired length and width. The representative examples include an optical compensation sheet, various photographic films, photographic printing paper, and a magnetic tape.

A usable method of applying a coating liquid includes not only the above described bar coating method but also a curtain coating method, an extrusion coating method, a roll coating method, a dip coating method, a spin coating method, a printing coating method, a spray coating method and a slide coating method. In particular, the bar coating method, the extrusion coating method and the slide coating method can be preferably used.

In addition, the number of coated layers of a coating liquid to be simultaneously applied is not limited to one in the present invention, but many layers can be simultaneously formed, as needed.

[Coating Liquid]

In the next place, a coating liquid to be used in the present invention will be described. Any coating liquid can be used in a method for drying a coated film according to the present invention without being limited in particular. However, the coating liquid preferably has such a ratio of surface tension at 10 msec to surface tension at 1,000 msec (surface tension at 10 msec after having been applied/surface tension at 1,000 msec after having been applied) as to satisfy 1.00 to 1.20 when the surface tension is measured with a maximum bubble pressure method on the coating liquid having a product C×F of 0.05 to 0.12, where (C) is the concentration by mass % of a polymer containing a fluoroaliphatic group in the coating liquid, and (F) is a fluorine content by % in the polymer containing the fluoroaliphatic group. When the surface tension of the coating liquid is appropriately adjusted, the coating liquid can acquire improved leveling characteristic, so that the coating liquid having the surface tension ratio adjusted into the above described range can be suitably used for an optical anisotropic layer.

Specifically, when the above described surface tension ratio is higher than 1.20, the liquid in the coated film right after having been applied slowly migrates to the interface between the air and the coated film, the surface of the coated film is unstable on the interface between the air and the coated film, and the coating liquid does not show a sufficient effect of reducing irregularities in an initial drying step. When the surface tension ratio is in the above described range of 1.00 to 1.20, the coating liquid does not cause such deficiency and can further reduce irregularities in the initial drying step.

The content of a polymer containing a fluoroaliphatic group according to the present invention in a coating composition (coating component except solvent) mainly containing a liquid crystal compound is preferably in a range of 0.05 to 1 mass %, and more preferably is in a range of 0.1 to 0.5 mass %. This is because when the amount of the added polymer containing the fluoroaliphatic group is less than 0.05 mass %, the coating liquid does not show a sufficient effect of improving leveling characteristics, and when the amount exceeds 1 mass %, the polymer may give a bad influence on the performance of an optical film (for instance, uniformity of retardation).

In addition, the present inventors found that a surface tension of a coating liquid is closely related to a chemical structure of a polymer containing a fluoroaliphatic group to be added to the coating liquid, specifically, a terminal structure of at least one monomer containing the fluoroaliphatic group among monomers composing the polymer containing the fluoroaliphatic group.

Specifically, the surface tension of the coating liquid containing a large amount of organic solvent can be lowered by changing the terminal structure of the monomer containing the fluoroaliphatic group among monomers composing the polymer containing the fluoroaliphatic group from conventional $—(CF_2CF_2)_nH$ to $—(CF_2CF_2)_nF$. In addition, (n) is preferably 2 to 4, and more preferably is 2 or 3.

Furthermore, the polymer is preferably a copolymer which contains a first monomer containing a fluoroaliphatic group that is $—(CF_2CF_2)_3F$ and a second monomer containing a fluoroaliphatic group that is $—(CF_2CF_2)_2F$ for the terminal structure of the monomer containing the fluoroaliphatic group.

A part except the terminal structure in the polymer containing the fluoroaliphatic group is not limited in particular, but various repeating units can be adopted.

In the next place, a fluorine polymer will be described. A fluorine polymer to be preferably used in a drying method according to the present invention is a polymer containing a fluoroaliphatic group which contains at least one repeating unit introduced from a monomer containing the fluoroaliphatic group expressed by the following Chemical Formula (general formula) 1, and at least one repeating unit introduced from the monomer of a poly(oxyalkylene)acrylate and (or) a poly(oxyalkylene)methacrylate.

Chemical Formula (1)

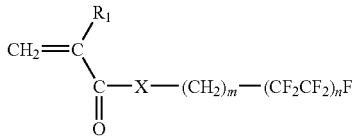

In the above Chemical Formula 1, $R_1$ represents a hydrogen atom or a methyl group; (X) represents an oxygen atom, a sulfur atom or $—N(R_2)—$; (m) represents an integer of 1 or more but 6 or less; and (n) represents an integer of 2 to 4. $R_2$ represents a hydrogen atom or an alkyl group having 1 to 4 carbon atoms, specifically, a methyl group, an ethyl group, a propyl group or a butyl group, and preferably the hydrogen atom or the methyl group; and the (X) represents preferably oxygen atom.

In the chemical formula (1), (m) is preferably an integer of 1 or more but 6 or less, and particularly preferably is 2. In addition, (n) is 2 or more but 4 or less, and particularly preferably is 2 or 3. It is acceptable to employ a mixture of those polymers.

Next, a poly(oxyalkylene)acrylate and (or) a poly(oxyalkylene)methacrylate will be described (hereinafter (meth) acrylate may be used as a word for meaning both acrylate and methacrylate together), which are other components composing the polymer containing the fluoroaliphatic group.

A poly oxyalkylene group can be expressed by (OR)x, wherein (R) is preferably an alkylene group having 2 to 4 carbon atoms, for instance, $—CH_2CH_2—$, $—CH_2CH_2CH_2—$, $—CH(CH_3)CH_2—$, or $—CH(CH_3)CH(CH_3)—$.

The above described poly(oxyalkylene) group may have the same oxyalkylene units therein as poly(oxypropylene), or may have two or more different oxyalkylenes irregularly distributed. The oxyalkylene unit may be an oxypropylene unit formed of a straight or branched chain, or an oxyethylene unit; or a block of oxypropylene units each formed of a straight chain or a branched chain, or a block of oxyethylene units.

The poly(oxyalkylene) chain can include a connected group in which a plurality of poly(oxyalkylene) units are mutually coupled with each other through one or more bonding chains (for instance, —CONH-Ph-NHCO—, —S— and the like, where Ph represents a phenylene group). When the bonding chain has 3 or more valences, the chain offers a device for giving the oxyalkylene unit a branched chain. In addition, when the copolymer is used in the present invention, the poly(oxyalkylene) group in the copolymer suitably has a molecular weight of 250 to 3,000.

The poly(oxyalkylene)acrylate and poly(oxyalkylene) methacrylate can be prepared by reacting a commercially available hydroxypoly(oxyalkylene) compound, for instance, "Pluronic" by a trade name (made by Asahi Denka Kogyo K. K.), "Adeka polyether" (made by Asahi Denka Kogyo K. K.), "Carbowax" (Glico Products Co., Inc.), "Toriton" (made by Rohm and Haas Company), and "P.E.G" (made by Dai-ichi Kogyo Seiyaku Co., Ltd.), with acrylic acid, methacrylic acid, acryl chloride, methacryl chloride, anhydrous acrylic acid or the like through a known method. Aside from the above prepared compounds, the poly(oxyalkylene)acrylate and poly(oxyalkylene)methacrylate can also employ poly (oxyalkylene)diacrylate which has been prepared with a known method.

One aspect of a polymer containing a fluoroaliphatic group to be used in the present invention is a copolymer of a monomer containing the fluoroaliphatic group expressed by chemical formula (general formula) (1) and a polyoxyalkylene (meth)acrylate.

A preferred aspect of the polymer containing the fluoroaliphatic group to be used in the present invention is a copolymer which contains a first monomer containing the fluoroaliphatic group having a terminal structure expressed by $—(CF_2CF_2)_3F$, and a second monomer containing the fluoroaliphatic group having a terminal structure expressed by $—(CF_2CF_2)_2F$, in general formula (1), and the polyoxyalkylene (meth)acrylate.

When the polymer containing the fluoroaliphatic group is employed, the polymer preferably contains the monomers containing the fluoroaliphatic group expressed by chemical formula (1) in a total amount of 20 to 50 mass % with respect to the total amount of monomers composing the polymer containing the fluoroaliphatic group, and more preferably in a total amount of about 40 mass %. The polymer containing the fluoroaliphatic group contains the monomers preferably so that the value of (the first monomer containing the fluoroaliphatic group)/(the first monomer containing the fluoroaliphatic group+the second monomer containing the fluoroaliphatic group) can be 20 to 80 mass %.

The polymer containing the fluoroaliphatic group to be used in the present invention preferably contains the monomers containing the fluoroaliphatic group expressed by g chemical formula (1) in a total amount of 5 to 60 mass % with respect to the total amount of monomers composing the polymer containing the fluoroaliphatic group, and more preferably in a total amount of about 35 to 45 mass %.

Poly(oxyalkylene)acrylate and/or poly(oxyalkylene) methacrylate preferably occupies 40 to 95 mass % of the total amount of monomers composing the polymer containing the fluoroaliphatic group, and further preferably occupies 55 to 65 mass %.

The polymer containing the fluoroaliphatic group according to the present invention preferably has a weight average molecular weight of 3,000 to 100,000, and further preferably has the weight of 6,000 to 80,000.

A polymer containing a fluoroaliphatic group according to the present invention can be produced with a well-known and commonly used method. The polymer can be produced, for instance, by adding a general-purposed radical polymerization initiator into an organic solvent containing a monomer such as (meth)acrylate having the above described fluoroaliphatic group and (meth)acrylate having a polyoxyalkylene group, and polymerizing the monomers. In some case, the polymer can be produced by further adding another addition-polymerizable unsaturated compound into the above solution and by using the same method as described above. It is also an effective method for obtaining a polymer with a uniform composition to polymerize while adding the monomers and an initiator dropwise into a reaction vessel, in consideration of the polymerizability of each monomer.

In the next place, a material for a coating liquid except the above described polymer containing the fluoroaliphatic group will be described.

(Liquid Crystalline Compound)

A preferably used liquid crystalline compound includes azomethines, azoxies, cyano biphenyls, cyanophenyl esters, benzoic acid esters, phenyl cyclohexanecarboxylates, cyanophenyl cyclohexanes, cyano-substituted phenyl pyrimidines, alkoxy-substituted phenyl pyrimidines, phenyl dioxanes, tolanes and alkenyl cyclohexyl benzonitriles.

In addition, the liquid crystalline compound includes a metallic complex as well. A usable liquid crystalline compound also includes a liquid crystal polymer containing a liquid crystalline compound in a repeating unit. In other words, the liquid crystalline compound may be combined with a (liquid crystal) polymer.

(Discotic Liquid Crystalline Compound)

A discotic liquid crystalline compound includes: a benzene derivative described in a research report written by C. Destrade et al. (Mol. Cryst. Vol. 71, Page 111 (1981)); a torxene derivative described in a research report written by C. Destrade et al. (Mol. Cryst. Vol. 122, Page 141 (1985) and Physics lett, A, Vol. 78, Page 82 (1990)); a cyclohexane derivative described in a research report written by B. Kohne et al. (Angew. Chem. Vol. 96, Page 70 (1984)); and an azacrown-based or phenyl-acetylene-based macrocycle described in a research report written by J. M. Lehn et al. (J.C.S., Chem. Commun., Page 1794 (1985)), and in a research report written by J. Zhang et al. (J. Am. Chem. Soc. Vol. 116, Page 2655 (1994)).

A composition for forming an optical anisotropic layer can concurrently employ an optional additive in addition to the above described liquid crystalline compound and polymer containing the fluoroaliphatic group. An example of the additive includes: a repellency inhibitor; an additive for controlling a tilt angle of an orientational film (tilt angle of liquid crystalline compound at interface between optical anisotropic layer and orientational film); a polymerization initiator; an additive (plasticizing agent) for lowering an orientation temperature; a polymerizable monomer and polymer; and a surface active agent.

(Repellency Inhibitor)

A repellency inhibitor can be used together with a liquid crystalline compound, in particular, a discotic liquid crystalline compound, so as to prevent repellency on an applied coating liquid. The repellency inhibitor is not limited in particular, as long as it has compatibility with the liquid crystalline and is a high molecular compound (polymer) which does not remarkably change the tilt angle or hinders the orientation of the liquid crystalline compound.

An example of a polymer usable as a repellency inhibitor is described in Japanese Patent Application Laid-Open No. 08-95030. Particularly preferable specific example of the polymer includes a cellulose ester. An example of the cellulose ester includes cellulose acetate, cellulose acetate propionate, hydroxypropylcellulose and cellulose acetate butyrate.

An amount of the added polymer usable as the inhibitor is preferably in a range of 0.1 to 10 mass % with respect to a liquid crystalline compound in general in order not to hinder the orientation of a liquid crystalline compound, more preferably is 0.1 to 8 mass %, and further preferably is 0.1 to 5 mass %.

(Agent for Controlling Tilt Angle in Orientational Film Side)

A compound having both polar group and non-polar group in a molecular can be added into an optical anisotropic layer, as an additive for controlling a tilt angle on the surface of an orientational film.

An example of the polar group includes R—OH, R—COOH, R—O—R, R—$NH_2$, R—NH—R, R—SH, R—S—R, R—CO—R, R—COO—R, R—CONH—R, R—CONHCO—R, R—$SO_3H$, R—$SO_3$—R, R—$SO_2NH$—R, R—$SO_2NHSO_2$—R, R—C═N—R, HO—P(—R)$_2$, (HO—)$_2$P—R, P(—R)$_3$, HO—PO(—R)$_2$, (HO—)$_2$PO—R, PO(—R)$_3$, R—$NO_2$ and R—CN. The example of the polar group may also include an organic salt (for instance, ammonium salt, pyridinium salt, carboxylate, sulfonate and phosphate).

A preferred polar group includes R—OH, R—COOH, R—O—R, R—$NH_2$, R—$SO_3H$, HO—PO(—R)$_2$, (HO—)$_2$PO—R, PO(—R)$_3$ and an organic salt. Here, (R) contained in the above described polar group represents a non-polar group, and includes, for instance, the following non-polar groups.

An example of the non-polar group includes: an alkyl group [preferably substituted or unsubstituted alkyl group of straight chain, branched chain, or cyclic chain having 1 to 30 carbon atoms]; an alkenyl group [preferably substituted or unsubstituted alkenyl group of straight chain, branched chain, or cyclic chain having 1 to 30 carbon atoms]; an alkynyl group [preferably substituted or unsubstituted alkynyl group of straight chain, branched chain, or cyclic chain having 1 to 30 carbon atoms]; an aryl group [preferably substituted or unsubstituted aryl group having 6 to 30 carbon atoms]; and a silyl group [preferably substituted or unsubstituted silyl group having 3 to 30 carbon atoms].

The non-polar groups may have further a substituent. An example of the substituent includes a halogen atom, an alkyl group (including a cycloalkyl group and a bicycloalkyl group), an alkenyl group (including cycloalkenyl group and bicycloalkenyl group), an alkynyl group, an aryl group, a heterocycle group, a cyano group, a hydroxyl group, a nitro group, a carboxyl group, an alkoxy group, an aryloxy group, a cyriloxy group, a hetercyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulphonyl group, an arylsulphonyl group, an acyl group, an aryloxycarbonyl group, an alkoxycarbonyl group, a carbamoyl group, an aryl azo group, a heterocyclic azo group, an imido group, a phosphino group, a phosphinyl group, a phosphinyloxy group, a phosphinylamino group and a silyl group.

An agent for controlling the tilt of an orientational film can be also added to a composition for forming an optical anisotropic layer. A tilt angle of a liquid crystalline molecule of the interface in an orientational film side of the coated film can be adjusted by orientating molecules of a liquid crystalline compound in the presence of the agent for controlling a tilt of the orientational film. A shifted amount of the tilt angle in this case relates to rubbing density. When an orientational film with a high rubbing density is compared to an orientational film with a low rubbing density, the tilt angle of the orientational film with the low rubbing density tends to easily vary even though both orientational films contain the same amount of the agent for controlling the tilt of the orientational film. Thus, the preferred range of the amount of the agent for controlling the tilt of the orientational film varies depending on the rubbing density of the orientational film to be used and the degree of the desired tilt angle, but is preferably 0.0001 to 30 mass % with respect to a mass of a liquid crystalline compound in general, more preferably is 0.001 to 20 mass %, and further preferably is 0.005 to 10 mass %. Here, the tilt angle means an angle formed by a longitudinal direction of a molecule of a liquid crystalline compound and a normal line for an interface (interface between liquid crystalline compound and orientational film, or interface between liquid crystalline compound and air).

(Polymerization Initiator)

It is preferable to form an optical anisotropic layer while fixing the molecules of a liquid crystalline compound in an oriented state. A method of using a polymerization reaction is preferable as a method for fixing the oriented state. The polymerization reaction includes a thermal polymerization reaction using a thermal polymerization initiator and a photopolymerization reaction using a photoinitiator, but the photopolymerization reaction is preferable in order to prevent a support from causing deformation or deterioration due to heat.

An example of the photoinitiator includes: an α-carbonyl compound (described in U.S. Pat. No. 2,367,661 and U.S. Pat. No. 2,367,670); acyloin ether (described in U.S. Pat. No. 2,448,828); an monocarbide hydrogen substituted α-aromatic acyloin compound (described in U.S. Pat. No. 2,722,512); a multinucleated quinone compound (described in U.S. Pat. No. 3,046,127 and U.S. Pat. No. 2,951,758); a combination of triaryl glyoxaline dimer and ρ-aminophenyl ketone (described in U.S. Pat. No. 3,549,367); an acridine and phenazine compound (described in each of Japanese Patent Application Laid-Open No. 60-105667 and U.S. Pat. No. 4,239,850); and an oxadiazole compound (described in U.S. Pat. No. 4,212,970).

An amount of a photoinitiator to be used the coating liquid is preferably in a range of 0.01 to 20 mass % of a solid content of the coating liquid, and more preferably is 0.5 to 5 mass %. A light to be used for irradiating the coating liquid to polymerize the liquid crystalline molecules is preferably an ultraviolet light.

An irradiation energy is preferably in range of 20 mJ/cm$^2$ to 50 J/cm$^2$, more preferably is in range of 20 mJ/cm$^2$ to 5,000 mJ/cm$^2$, and further preferably is in range of 100 mJ/cm$^2$ to 800 mJ/cm$^2$. It is acceptable to irradiate the coated film with the light while heating the coated film, in order to promote a photopolymerization reaction. A protective layer may be provided on an optical anisotropic layer.

(Polymerizable Monomer)

A composition for forming an optical anisotropic layer may include a polymerizable monomer together with a liquid crystalline compound. The polymerizable monomer usable in the present invention is not limited in particular as long as the monomer has compatibility with a liquid crystalline compound and does not remarkably change a tilt angle or hinder the orientation of the liquid crystalline compound. Among the polymerizable monomers, a preferably used compound has an ethylenic unsaturated group with polymerization activity, such as a vinyl group, a vinyloxy group, an acryloyl group and a methacryloyl group. An added amount of the above described polymerizable monomer is generally in a range of 1 to 50 mass % with respect to a liquid crystalline compound, and preferably is 5 to 30 mass %. When the monomer has two or more reactive functionalities, the monomer can be expected to show an effect of improving adhesiveness between the orientational film and the optical anisotropic layer, and accordingly is particularly preferable.

(Polymer)

A composition for forming an optical anisotropic layer includes a polymer containing a fluoroaliphatic group according to the present invention, but may further include another polymer together with a discotic liquid crystalline compound. The polymer preferably has some degree of compatibility with the discotic liquid crystalline compound, and can change the tilt angle of the discotic liquid crystalline compound.

Examples of such a polymer include a cellulose ester. A preferred example of the cellulose ester includes cellulose acetate, cellulose acetate propionate, hydroxypropyl cellulose and cellulose acetate butyrate.

An amount of the above described polymer to be added into the composition is preferably in a range of 0.1 to 10 mass % with respect to the discotic liquid crystalline compound, so as not to hinder the orientation of the discotic liquid crystalline compound, more preferably is 0.1 to 8 mass %, and further preferably is 0.1 to 5 mass %. The discotic liquid crystalline compound has a discotic nematic liquid crystal phase-solid phase conversion temperature preferably in a range of 70 to 300° C., and further preferably in a range of 70 to 170° C.

(Application Solvent)

A composition for forming an optical anisotropic layer can be prepared as a coating liquid. A solvent to be preferably used for preparing the coating liquid is an organic solvent.

Examples of the organic solvent include: an amide (for instance, N,N-dimethylformamide); an sulfoxide (for instance, dimethylsulfoxide); a heterocyclic compound (for instance, pyridine); a hydrocarbon (for instance, benzene and hexane); an alkyl halide (for instance, chloroform and dichloro-methane); an ester (for instance, methyl acetate and butyl acetate); a ketone (for instance, acetone and butanone); and an ether (for instance, tetrahydrofuran and 1,2-dimethoxyethane). The alkyl halide and the ketone are preferable. Two or more organic solvents may be concurrently used.

(Coated Film)

A coating film formed through a drying method according to the present invention shows preferably a fluorine atom abundance ratio (F/C) measured with an ESCA method of 2 to 10, at a position of 10 nm in a depth direction from the interface between the air and the coating film, when a fluorine atom abundance ratio (F/C) measured at the interface between the air and the coating film is assumed to be 100. The drying method makes the fluorine concentration of the coating film high on the surface, makes fluorine exist in the inner part of the coating film as well, and accordingly can form the coating film showing an excellent appearance.

EXAMPLES

A substantial effect of the present invention will now be described below with reference to examples.

Test Example 1

Drying Apparatus

Examples 1 to 6 and Comparative examples 1 and 2 were prepared by drying respective coated films on conditions described in the Table at an air speed of 0.01 to 0.5 m/s with the use of a drying apparatus according to the present invention, and it was confirmed whether the coating films formed the spots or not. Air velocity was measured in such a condition that a wind speed indicator shows the maximum value when rotated in 360 degrees in a state in which the line is stopped.

Figure 3:
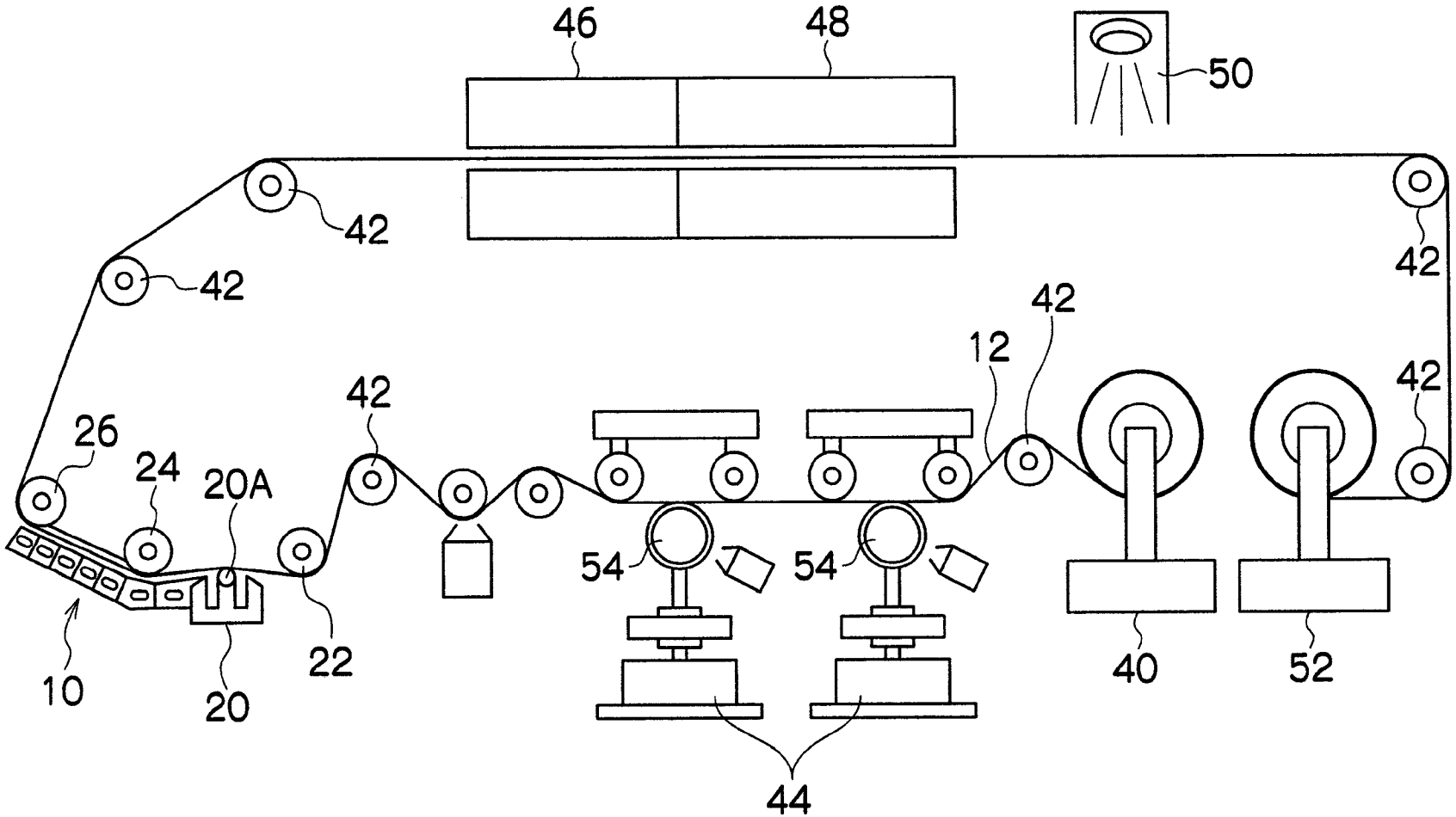
FIG. 3 is a diagram of a process for manufacturing an optical compensation sheet, which incorporates a drying apparatus according to the present invention.

At first, a process of manufacturing an optical compensation sheet will now be described. As is shown in FIG. 3, a web 12 sent off by a pay-off machine 40 passes a rubbing treatment device 44, an applicator 20, the drying apparatus 10 according to present invention for initially drying the coated film, a drying zone 46 for fully drying the coating film, a heating zone 48, and an ultraviolet lamp 50 while being supported by a plurality of guide rollers 42, and is coiled up by a winder 52.

A triacetylcellulose film (Fujitac which is a product made by Fuji Photo Film Co., Ltd.) with a thickness of 80 μm was used for a web 12. A orientational film was formed on the surface of the web 12 by the steps of: applying a 2 wt. % solution of a long-chain alkyl modified Poval (MP-203 which is a product made in Kuraray Co., Ltd.) in an amount of 25 ml per square meter of a film; forming a resin layer for an orientational film on the web 12 by drying the coated film at 60° C. for one minute; and rubbing the surface of the resin layer while running the web 12 at 30 m/min.

A coating liquid to be applied on the orientational film obtained through the rubbing treatment of the resin layer for the orientational film was prepared by the steps of: preparing a mixture of (3) of a discotic compound TE-8 and (5) of a discotic compound TE-8 blended with 4:1 by a weight ratio; preparing a mixture by adding a photoinitiator (IRGACURE 907 which is made by Nihon Ciba-Geigy K.K.) in an amount of 1 wt. % with respect to the above described mixture; and dissolving the resultant mixture into methyl ethyl ketone to prepare a 40 wt. % methyl ethyl ketone solution containing a liquid crystalline compound. The coating liquid was applied onto the orientational film with a wire bar 20A so that an amount of the coated liquid can be 5 to 7 ml per square meter of the web, while a web 12 is run at a running speed of 30 m/min. Then, the coated film was initially dried right after having been coated with the use of the drying apparatus 10.

When the coated film was initially dried, a space between the top end of a partitioning plate 28 that divides a drying zone 14 and the surface of the coated film was set in a range of 5 to 9 mm. The web 12 which has been initially dried by the drying apparatus 10 was passed through the drying zone 46 adjusted to 100° C. and a heating zones 48 adjusted to 130° C. to form a nematic phase thereon; subsequently the web 12 which has been coated with the orientational film and the liquid crystalline compound was continuously transported; and then, the surface of the liquid crystal layer was irradiated with an ultraviolet light emitted from an ultraviolet lamp 50.

Figure 5A:
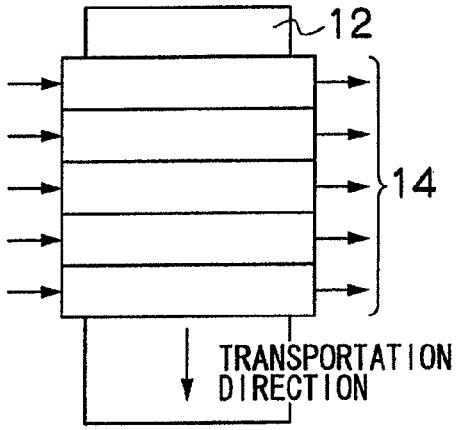
FIG.5A PRIOR ART
FIG. 5A is a view showing a wind direction of drying air in a conventional drying apparatus.
Figure 5B:
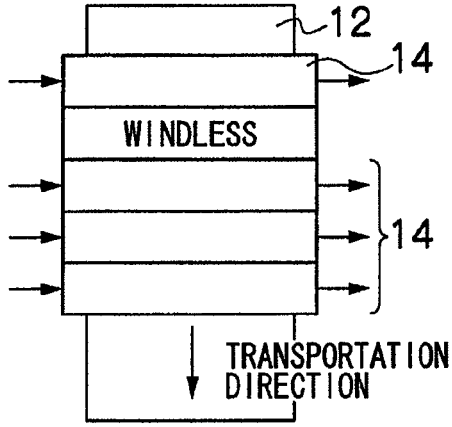
FIG. 5B is a view showing a wind direction of the drying air having an airless zone at some midpoint of the conventional drying apparatus.
Figure 5C:
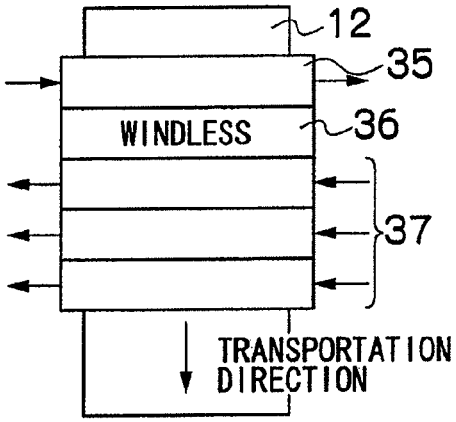
FIGS. 5C to 5E are views showing wind directions of the drying air in the drying apparatus according to the present invention.
Figure 5D:
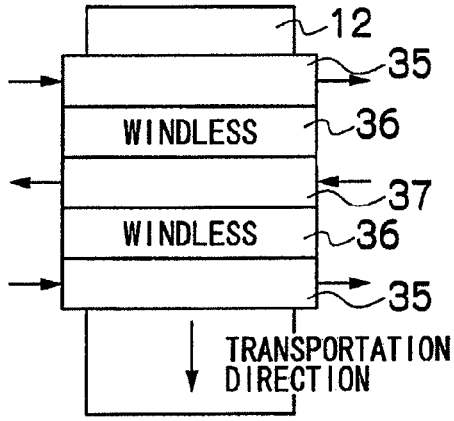
Figure 5E:
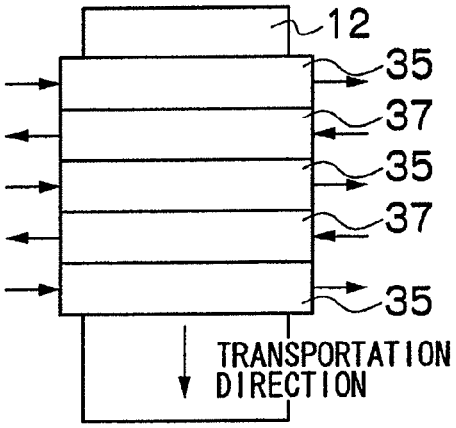
Figure 10:
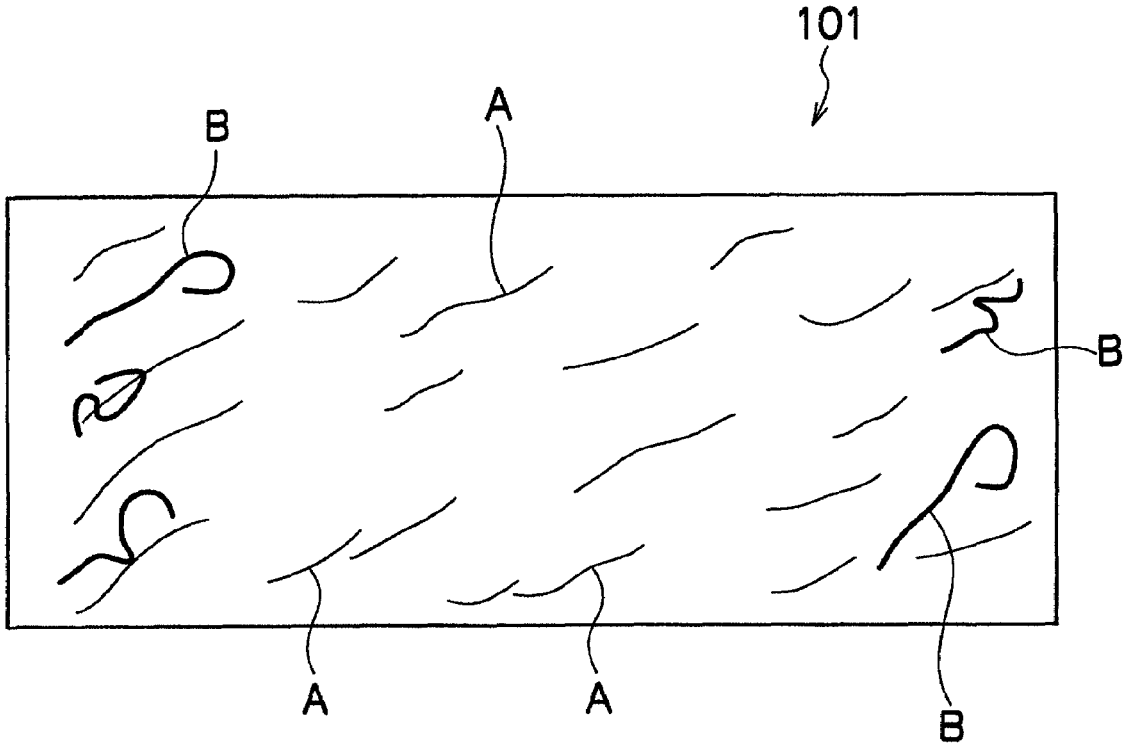
FIG. 10 is a view of spots (irregularities) produced in a conventional drying method.
Figure 11:
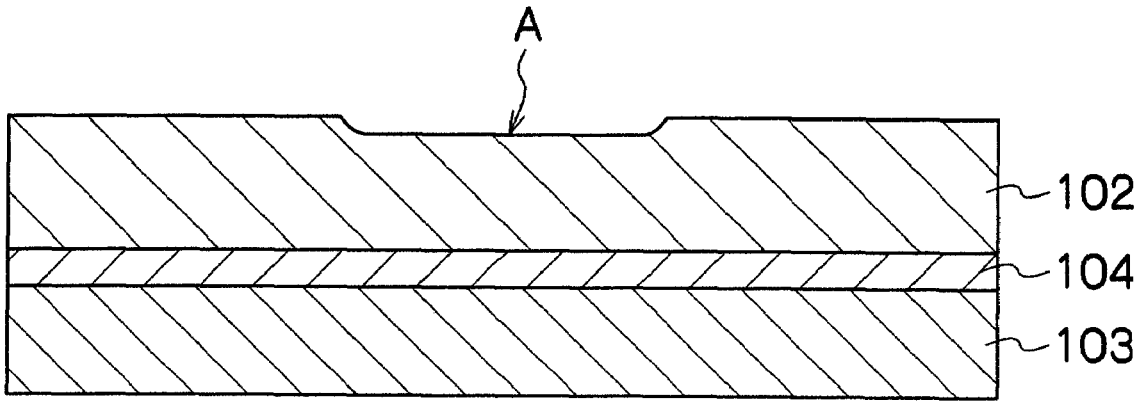
FIG. 11 is an explanatory drawing for describing a broad spot (irregularities)
Figure 12:
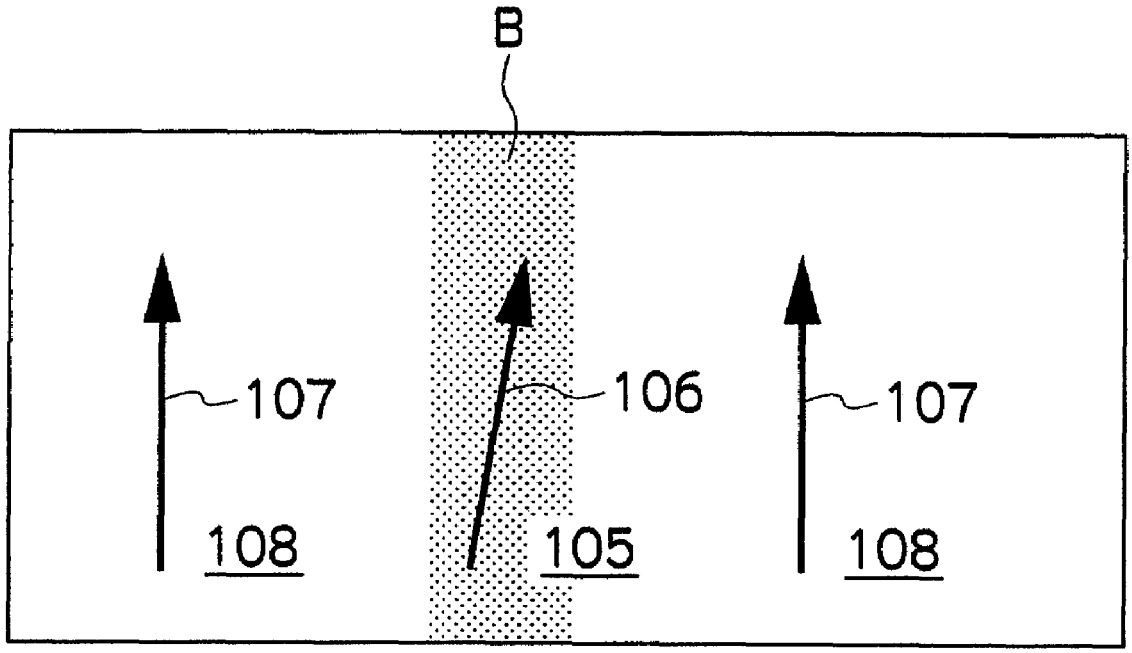
FIG. 12 is an explanatory drawing for describing a sharp spot (irregularities).

The direction of wind in the drying apparatus 10 is shown in FIGS. 5A to 5E. FIG. 5A shows the direction of the wind in a conventional drying apparatus. FIG. 5B illustrates the direction of the wind in a windless zone installed at some midpoint of the conventional drying apparatus. FIGS. 5C to 5E illustrate the direction of the wind in a drying apparatus according to the present invention. As illustrated in FIGS. 5A to 5E, the drying apparatus according to the present invention, there are the following three types of: having forward air zones 35 and reverse air zones 37 alternately prepared as is illustrated in FIG. 5E; having forward air zones 35 and reverse air zones 37 alternately prepared, and the windless zone 36 is prepared between the forward air zone 35 and the reverse air zone 37, as is illustrated in FIG. 5D; and having the airless zone 36 prepared between the forward air zone 35 and the reverse air zone 37 as is illustrated in FIG. 5C.

Results are shown in FIG. 6. The state of produced spots and the over-all judgment described in FIG. 6 were evaluated according to the following criterion. In the evaluation, the state of the produced spots and a dried state were examined through visual inspection.

(State of Produced Spots)

Excellent: No spot was produced.

Good: A few spots were produced but were spots in a level of causing no problem of quality at all.

Fair: Spots were produced but were spots in a level of causing no problem of quality.

Bad: Spots were produced.

(Dried State)

Excellent: The coated film was completely dried at the outlet of the drying zone.

Good: The coated film was incompletely dried in an earing part between the edge and a 3 mm inner part from the edge, but the overall coated film was dried.

Bad: The whole coated film was insufficiently dried.

(General Evaluation)

Excellent: The coated film is acceptable as a product and has an excellent surface state.

Good: The coated film is acceptable as a product, and besides, has a good surface state.

Fair: The coated film is acceptable as a product.

Bad: The coated film is unacceptable as a product.

As a result, Comparative example 1 and Comparative example 2 in which drying air was supplied only from one end to the other end showed an incomplete dried state on the support in a supply side of the drying air at the air supply side of the drying air, as is understood from FIG. 6. In addition, Example 2 in which the windless zone was long showed a slightly insufficient dried state and irregularities.

In addition, an example prepared by using a long windless zone or a short windless zone showed a sharp spot (B), though being good as a product.

Example 6 in which the windless zone is prepared in between the forward air zone and the reverse air zone that were alternated could have an adequate surface of the coating film formed on the web free from a broad spot (A), because of preparing the windless zone in a finish drying step and thereby preventing adjacent drying airs to each other from being mixed.

As describe above, the drying apparatus could uniformly dry the web and inhibit the drying spots from being produced by supplying the drying airs so as to face each other across the width of a long support. The drying apparatus could also inhibit a sharp spot (B) from being produced, because of preparing a windless zone in between divided zones in which the drying airs flow in opposite directions, and thereby preventing the drying airs from joining to each other.

Test Example 2

Coating Liquid (Surface Tension)

A coating liquid was prepared by dissolving ingredients of a composition illustrated in FIG. 7, into methyl ethyl ketone. The following discotic liquid crystalline compound (1) was used as a discotic liquid crystalline compound. In addition, polymers containing a fluoroaliphatic group used for preparing the coating liquid were the following compounds (P-0) to (P-4).

Thus, the coating liquids having different compositions of the polymer containing the fluoroaliphatic group and the like were prepared, and were applied onto a transparent support with an extrusion coating method (E type). Then, a relationship between the change with the time-varying surface tension of the coating liquid right after having been applied and an appearance was evaluated.

The surface tension of the coating liquid was measured with a maximum bubble pressure method by using a dynamic surface tension measurement instrument (MPT2 which is made by LAUDA). The surface tension was determined according to the above method by the steps of: putting a fixed amount of the coating liquid containing the polymer containing the fluoroaliphatic group in a beaker; blowing nitrogen

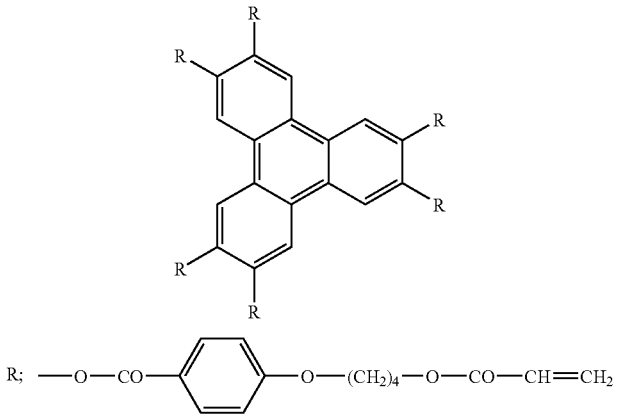

discotic liquid crystalline compound (1)

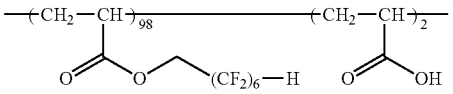

Compound (P-0): monomer containing acidic group

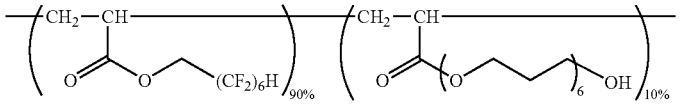

Compound (P-1): ωHC6 type polymer

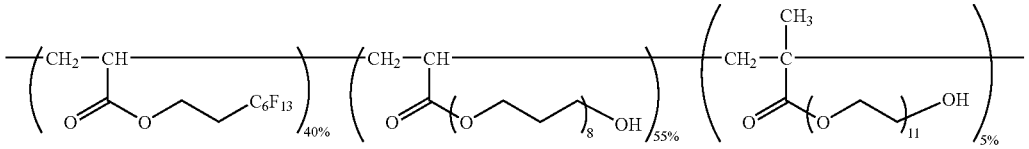

Compound (P-2): ωFC6 type polymer

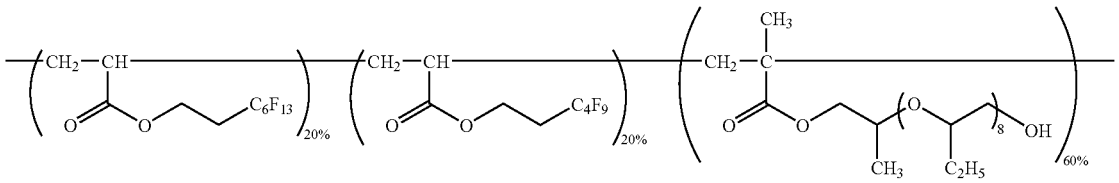

Compound (P-3): ωF(C6 + C4) type polymer

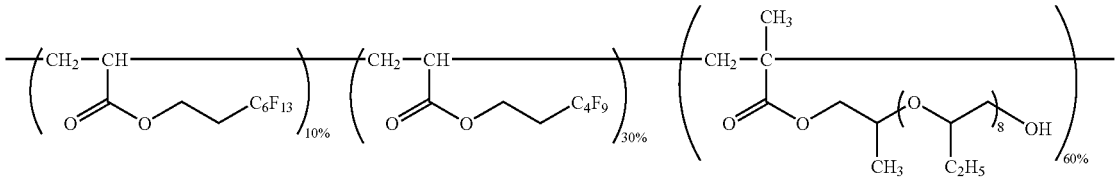

Compound (P-4): ωF(C6 + C4) type polymer gas from a capillary inserted into the beaker and forming a bubble; and measuring the maximum pressure when an interface between the liquid and air is expanded. The results are shown in FIG. 8.

As is shown in FIG. 8, Examples 7 and 8 which were prepared by using a ωF(C4+C6) type polymer as the polymer containing the fluoroaliphatic group showed a lower surface tension from the time right after the coating liquid was applied, than Comparative examples 3, 5 and 6 which were prepared by using a ωFC4 type polymer or a ωFC6 type polymer. As is shown in FIG. 8, the Examples 7 and 8 also showed as small a ratio of surface tensions (surface tension after 10 msec/surface tension after 1,000 msec) as 1.1 $mN/m^2$.

It is understood from the results that Examples 7 and 8 prepared by using the ωF(C4+C6) type polymer as a polymer containing the fluoroaliphatic group have a higher adsorption rate at an interface between air and the coated liquid right after having been applied and a higher effect of stabilizing the surface of the coated film than comparative examples 3, 5 and 6 which are prepared by using the ωFC4 type polymer or the ωFC6 type polymer singly. From the results, it was understood that the coating liquid can prevent irregularities from occurring in an initial drying step, and can improve the appearance of an optical film.

In addition, it was found that Comparative example 4 which was prepared by using an ωH type polymer as a polymer containing a fluoroaliphatic group had a low surface tension and a high adsorption rate to the interface between the air and the coated liquid right after the coating liquid has been applied, but showed a low effect of stabilizing the interface between the air and the coated liquid because of having an H group in a part of the ωH type polymer and consequently an inferior appearance. In addition, a similar test was carried out by using a bar application method, and as a result, a similar result was obtained.

Test Example 3

Coating Liquid (Abundance Ratio of Fluorine Atom)

A coated film was formed and dried by using a drying apparatus according to the present invention and coating liquids of Example 7 and Comparative examples 3 and 4. The coated film was formed so that an amount of a coated liquid can be 5 ml to 7 ml per square meter of the web, while a web was run at a running speed of 30 m/min. The abundance ratio of the fluorine atom in the coated films after having been dried was measured with an ESCA technique. The result is illustrated in FIG. 9. The fluorine concentration was measured with the ESCA technique by using JPS-9000MX made by JEOL. Appearance characteristics in FIG. 9 were evaluated according to the following criterion.

(Preparation of Polarizing Plate)

A produced optical film was stuck on one side of a polarizer on the surface of a polymer substrate (TAC film) with the use of a polyvinyl alcoholic adhesive. In addition, a triacetylcellulose film with a thickness of 80 μm (TD-80U: made by Fuji Photo Film) was saponified and was stuck on the reverse side of the polarizer, with the use of the polyvinyl alcoholic adhesive.

The polymer substrate was positioned on the polarizer so that the retardation axis of the polymer substrate could be parallel to the transmission axis of the polarizer. The above described triacetylcellulose film was positioned on the polarizer so that the retardation axis of the triacetylcellulose film could be perpendicular to the transmission axis of the polarizer. Thus, the polarizing plate was prepared.

(Evaluation of Irregularities on Planar High-Intensity Light Source)

The above described polarizing plate was affixed to the planar high-intensity light source (FP901 high-intensity planar light source made by Gunma Ushio Corporation), and the appearance was compared with that of a level sample of a decision criterion. Then, the degree of irregularities was visually evaluated.

Good: Superior to level sample

Bad: Inferior to level sample

As a result, Example 6 which employed the coating liquid containing a compound (P-3) for the polymer containing the fluoroaliphatic group showed 100% of a fluorine concentration on the surface of the formed coating layer, included fluorine in the inner part of the coating film in a depth direction, and provided the coating layer having adequate appearance characteristics. Comparative example 2 which employed a compound (P-2) and Comparative example 3 which employed a compound (P-1) showed inadequate appearance characteristics, because fluorine existed only on the surface of the coating film or the fluorine concentration on the surface was not 100%.

What is claimed is:

1. A method for drying a coated film formed by applying a coating liquid containing an organic solvent onto a running long support, the method which sequentially conducts, immediately after the application, following steps in a drying zone where a coated surface to be dried of the running long support is surrounded:

a forward wind drying step of drying the surface of the coated film with a forward wind while running the long support in a forward wind zone in which such a drying air is supplied as to flow only in one direction from one end side to the other end side across the width of the long support;

a reverse wind drying step of drying the surface of the coated film with a reverse wind while running the long support in a reverse wind zone in which such a drying air is supplied as to flow only in one direction reverse to that in the forward wind zone, i.e., from the other end side to one end side across the width of the long support; and further comprising a windless drying step of drying the surface of the coated film while running the long support in a windless zone in which the drying air is not blown, in between the forward wind drying step and the reverse wind drying step.

2. The method for drying the coated film according to claim 1, wherein the forward wind drying step and the reverse wind drying step are alternately repeated a plurality of times.

3. The method for drying the coated film according to claim 1, wherein the windless zone has a length of 80 mm or longer but 2,000 mm or shorter in a running direction of the long support.

4. The method for drying the coated film according to claim 2, wherein the windless zone has a length of 80 mm or longer but 2,000 mm or shorter in a running direction of the long support.

5. A method for drying a coated film formed by applying a coating liquid containing an organic solvent onto a running long support, the method which sequentially conducts, immediately after the application, following steps in a drying zone where a coated surface to be dried of the running long support is surrounded:

a forward wind drying step of drying the surface of the coated film with a forward wind while running the long support in a forward wind zone in which such a drying air is supplied as to flow only in one direction from one end side to the other end side across the width of the long support; and a reverse wind drying step of drying the surface of the coated film with a reverse wind while running the long support in a reverse wind zone in which such a drying air is supplied as to flow only in one direction reverse to that in the forward wind zone, i.e., from the other end side to one end side across the width of the long support, wherein the coated film to be dried is formed by applying a coating liquid for a liquid crystal layer on an oriented film undergone a rubbing treatment in a process for manufacturing an optical compensation sheet.

6. The method for drying the coated film according to claim 4, wherein the coated film to be dried is formed by applying a coating liquid for a liquid crystal layer on an oriented film undergone a rubbing treatment in a process for manufacturing an optical compensation sheet.

7. The method for drying the coated film according to claim 1, wherein the coating liquid includes a polymer containing a fluoroaliphatic group containing a repetition unit derived from monomers described in the following item (1), and wherein the polymer containing the fluoroaliphatic group satisfies the condition described in the following item (2):

(1) a polymer containing the fluoroaliphatic group includes a first monomer containing a fluoroaliphatic group having a terminal structure expressed by —$(CF_2CF_2)_3F$, and a second monomer containing a fluoroaliphatic group having a terminal structure expressed by —$(CF_2CF_2)_2F$; and (2) the coating liquid shows a ratio of surface tension at 10 msec to surface tension at 1,000 msec (surface tension at 10 msec after the coating liquid has been applied/surface tension at 1,000 msec after the coating liquid has been applied) of 1.00 to 1.20 when the surface tension is measured with a maximum bubble pressure method on the coating liquid having a product C×F of 0.05 to 0.12, where (C) is the concentration by mass % of the polymer containing the fluoroaliphatic group in the coating liquid, and (F) is a fluorine content by mass % in the polymer containing the fluoroaliphatic group.

8. The method for drying the coated film according to claim 6, wherein the coating liquid includes a polymer containing a fluoroaliphatic group containing a repetition unit derived from monomers described in the following item (1), and wherein the polymer containing the fluoroaliphatic group satisfies the condition described in the following item (2):

(1) a polymer containing the fluoroaliphatic group includes a first monomer containing a fluoroaliphatic group having a terminal structure expressed by —$(CF_2CF_2)_3F$, and a second monomer containing a fluoroaliphatic group having a terminal structure expressed by —$(CF_2CF_2)_2F$; and (2) the coating liquid shows a ratio of surface tension at 10 msec to surface tension at 1,000 msec (surface tension at 10 msec after the coating liquid has been applied/surface tension at 1,000 msec after the coating liquid has been applied) of 1.00 to 1.20 when the surface tension is measured with a maximum bubble pressure method on the coating liquid having a product C×F of 0.05 to 0.12, where (C) is the concentration by mass % of the polymer containing the fluoroaliphatic group in the coating liquid, and (F) is a fluorine content by mass % in the polymer containing the fluoroaliphatic group.

9. The method for drying the coated film according to claim 7, wherein the formed coating film shows an abundance ratio of a fluorine atom (F/C) measured with an ESCA method of 2 to 10, at a position of 10 nm from the interface between the air and the coating film in a depth direction, when the abundance ratio of the fluorine atom (F/C) measured at the interface between the air and the coating film is assumed to be 100, wherein C is an abundance of carbon in the coating film.

10. The method for drying the coated film according to claim 8, wherein the formed coating film shows an abundance ratio of a fluorine atom (F/C) measured with an ESCA method of 2 to 10, at a position of 10 nm from the interface between the air and the coating film in a depth direction, when the abundance ratio of the fluorine atom (F/C) measured at the interface between the air and the coating film is assumed to be 100, wherein C is an abundance of carbon in the coating film.

11. The method of claim 1, wherein the forward wind drying step and the reverse drying step occur on the running long support simultaneously, respectively in the forward wind zone and the reverse wind zone.

* * * * *